US006507332B1

(12) United States Patent
Kuwabara et al.

(10) Patent No.: US 6,507,332 B1
(45) Date of Patent: Jan. 14, 2003

(54) ACTIVE-MATRIX-TYPE IMAGE DISPLAY AND A DRIVING METHOD THEREOF

(75) Inventors: Nobuhiro Kuwabara, Tenri (JP); Hiroshi Yoneda, Ikoma (JP); Akihito Jinda, Kitakatsuragi-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/099,018

(22) Filed: Jun. 17, 1998

(30) Foreign Application Priority Data

Jun. 27, 1997 (JP) ..... 9-172567

(51) Int. Cl.[7] ..... G09G 3/36
(52) U.S. Cl. ..... 345/103; 345/99
(58) Field of Search ..... 345/206, 98, 50, 345/55, 92, 88, 100, 99, 204, 103; 349/155, 38; 257/99

(56) References Cited

U.S. PATENT DOCUMENTS

| | | | | |
|---|---|---|---|---|
| 4,716,403 A | * | 12/1987 | Morozumi | 345/88 |
| 4,779,086 A | * | 10/1988 | Kanno et al. | 345/92 |
| 4,870,399 A | * | 9/1989 | Carlson | 345/55 |
| 4,890,101 A | * | 12/1989 | Carlson | 345/55 |
| 5,192,945 A | * | 3/1993 | Kusada | 345/88 |
| 5,376,944 A | * | 12/1994 | Mogi et al. | 345/100 |
| 5,610,414 A | * | 3/1997 | Yoneda et al. | 257/99 |
| 5,654,735 A | * | 8/1997 | Nakajima | 345/99 |
| 5,889,504 A | * | 3/1999 | Kihara et al. | 345/100 |
| 5,973,661 A | * | 10/1999 | Kobayashi et al. | 345/100 |
| 6,025,835 A | * | 2/2000 | Aoki et al. | 345/204 |

FOREIGN PATENT DOCUMENTS

| | | |
|---|---|---|
| JP | 57-205789 | 12/1982 |
| JP | 01-123293 | 5/1989 |
| JP | 03-132789 | 6/1991 |
| JP | 05-232899 | 9/1993 |
| JP | 6-27903 | 2/1994 |
| JP | 7-175451 | 7/1995 |
| JP | 08-122748 | 5/1996 |
| JP | 8-305322 | 11/1996 |
| JP | 9-55909 | 2/1997 |
| JP | 10-260657 | 9/1998 |

* cited by examiner

*Primary Examiner*—Steven Saras
*Assistant Examiner*—Uchendu O. Anyaso
(74) *Attorney, Agent, or Firm*—Edwards & Angell, LLP; David G. Conlin; John J. Penny, V

(57) ABSTRACT

A driving method for an active-matrix-type image display in which: in the case when the number of divisions of a video signal decreases in accordance with the scanning frequency of an original video signal, eight video signal lines 31*a* through 31*h* are divided into groups the number of which corresponds the reduced number of divisions so that the same video signal is inputted to the video signal lines 31 belonging to the same group; and four systems of shift registers SRA through SRD are also divided into groups, SRA, SRB, SRC and SRD so that the same shift clock signal is inputted to the same group. With this method, even upon application of the device to a usage having a different scanning frequency, the construction of the external circuits are optimized so as to fit the different scanning frequency, and the shared use of the substrate is available so that cost reduction is achieved.

11 Claims, 20 Drawing Sheets

ACTIVE-MATRIX-TYPE IMAGE DISPLAY AND A DRIVING METHOD THEREOF

FIELD OF THE INVENTION

The present invention relates to an active-matrix-type image display having a plurality of video signal lines installed therein and its driving method.

BACKGROUND OF THE INVENTION

In an active-matrix-type liquid crystal display having an integrated driving circuit, it is necessary to provide driving circuits, such as a source driver and a gate driver on an insulating substrate made of glass, crystal, etc., as integral parts with a display section, and the driving circuits are normally formed by polysilicon thin-film MOS transistors (hereinafter, referred to as polysilicon TFTs).

However, the driving circuit using polysilicon TFTs has the disadvantage of a very slow operation speed as compared with a driving circuit using monocrystal silicon. In particular, in the case where a large-screen, high-capacity displaying operation is carried out in the source driver for driving the source bus line in the display section, since sift registers constituting the source driver fail to provide a sufficient operation speed, various methods for carrying out a driving operation without exceeding the speed of the shift registers constituted by polysilicon TFTs have been considered.

FIG. 18 shows an active-matrix-type liquid crystal display of a driving-circuit-build-in type using two systems of shift registers, which is one example of a method for decreasing the operation speed required for the sift registers. Referring to FIG. 18, an explanation will be given of a construction of a conventional active-matrix-type liquid crystal display of the driving-circuit-built-in type.

As illustrated in the Figure, in this liquid crystal display, source bus lines $s_1$ through $s_N$ and gate bus lines $g_1$ through $g_M$ are wired in warp and woof on an insulating substrate 101 so that a display section 102 is formed. On the substrate 101 on which the display section 102 is formed, a source driver 103 for driving the source bus lines $s_1$ through $s_N$ is formed at one end of the source bus lines $s_1$ through $s_N$ and a gate driver 104 for driving the gate bus lines $g_1$ through $g_M$ is formed at one end of the gate bus lines $g_1$ through $g_M$.

In the display section 102, each of portions, surrounded by the source bus lines $s_n$ ($1 \leqq n \leqq N$) and the gate bus lines $g_m$ ($1 \leqq m \leqq M$), forms a pixel 120 which is one unit of display. Referring to FIG. 2 that is an explanatory drawing of one Embodiment of the present invention, an explanation will be given of the pixel 120. The pixel 120 is constituted by a thin-film transistor 20*a* functioning as a switching element that is formed at an intersecting point between each source bus line $S_n$ and each gate bus line $G_m$, a pixel electrode 20*b* to which video signal electric potentials $D_1$, $D_2$, etc. provided from the source bus lines $S_n$ are applied so as to drive a liquid crystal capacitor and a charge-holding capacitor 20*c* installed in parallel with the pixel electrode 20*b*.

As illustrated in FIG. 18, the source driver 103 is constituted by two video signal lines 131*a* and 131*b* for inputting video signals VideoI and VideoII to the source bus lines $s_1$ through $s_N$, a sampling circuit constituted by an analog switch 132 formed between the video signal lines 131*a*·131*b* and the respective source bus lines $s_1$ through $s_N$, and two systems of shift registers SRa and SRb for controlling the operation of the analog switch 132.

The odd numbered source bus lines $s_1$ through $s_{N-1}$ are connected to the video signal line 131*a* so that the video signal VideoI is applied thereto. The even numbered source bus lines $s_2$ through $s_N$ are connected to the video signal lines 131*b* so that the video signal VideoII is applied thereto. The analog switch 132 is used for sampling the video signals VideoI and VideoII from the video signal lines 131*a* and 131*b*.

The two systems of shift registers SRa and SRb are alternately connected to the source bus lines $s_1$ through $s_N$ so that the shift register SRa controls the operation (opening and shutting) of the analog switch 132 corresponding to the odd numbered source bus lines $s_1$ through $s_{n-1}$, while the shift register SRb controls the operation of the analog switch 132 corresponding to the even numbered source bus lines $s_2$ through $s_N$.

The respective parts constituting the source driver 103 are formed on the same substrate 101 by using polysilicon thin-films, etc.

FIG. 19 shows a timing chart upon driving the source driver 103 shown in FIG. 18. Referring to FIGS. 18 and 19, an explanation will be given of the driving operation of the source driver 103.

The activation of the two systems of shift registers SRa and SRb is controlled by a shift start signal SP shown in FIG. 19. The shift register SRa is controlled by shift clock signals $\phi A \cdot / \phi A$ and the shift register SRb is controlled by shift clock signals $\phi B \cdot / \phi B$. Signals whose phases are shifted from each other by a ¼ period (a sampling period t0 corresponding to a value obtained by dividing the effective horizontal scanning period by the number of the effective source bus lines) are used as the shift clock signal $\phi A$ and the shift clock signal $\phi B$. Accordingly, these shift clock signals $\phi A \cdot / \phi A \cdot \phi B \cdot / \phi B$ allow the two shift registers SRa and SRb to output waveforms whose phases are respectively shifted from each other by the sampling period t0 to the analog switch 132 successively.

The video signals VideoI and VideoII, which are formed by outputting for the period 2*t*0 video signal electric potentials $D_1$, $D_2$, . . . , etc. that have been obtained by sampling an original video signal Video with its phase respectively shifted by period t0, are inputted to the two video signal lines 131*a* and 131*b* respectively. The method for forming the video signals VideoI and VideoII will be described later in detail.

In this case, the two analog switches 132, each of which is controlled by one output of each of the registers SRa and SRb, are connected to the respectively different video signal lines 131*a* and 131*b*, and successively sample the video signal electric potentials $D_1$, $D_2$, . . . , etc. having mutually different phases, as in the cases of video signals VideoI and VideoII shown in FIG. 19. The analog switch 132 is allowed to conduct during a period in which the output of each of the shift registers SRa and SRb goes high, and one output of each of the shift registers SRa and SRb allows one of the analog switches 132 to conduct for period 4*t*0.

During the period in which the analog switch 132 is allowed to conduct, the video signal VideoI or VideoII is sampled so that the source bus lines $s_1$ through $s_N$ are successively driven. Since the analog switch 132 in question is connected to the same video signal lines 131*a* and 131*b* that are connected to the analog switch 132 connected to the source bus lines $s_1$ through $s_N$ located two lines before, it is allowed to conduct with an overlapping period of 2*t*0 with the analog switch 132 connected to the source bus lines $s_1$ through $s_N$ located two lines before. As a result, the video signals VideoI and VideoII are sampled during the last period 2t0 (the period in which no overlapping is made with the source bus lines $s_1$ through $s_N$ located two lines before).

By carrying out the driving operation as described above, the video signal electric potentials $D_1$, $D_2$ . . . , etc., which are mutually shifted by the sampling period t0, are applied to the source bus lines $s_1$ through $s_N$.

Here, FIG. 20 shows one example of a video-signal forming circuit for converting an original video signal Video into two kinds of video signals VideoI and VideoII. Referring to FIG. 20, an explanation will be given of the construction of the video-signal forming circuit.

As illustrated in the Figure, an A/D conversion circuit, to which an original video signal Video is inputted and which. A/D converts the inputted original video signal Video as well as sampling it for the sampling period t0, is provided, and a gamma γ correction circuit 142 is connected to the output side thereof. The gamma correction circuit 142 is a circuit which carries out a correcting operation by non-linearly converting the output from the A/D conversion circuit 141 so that a correct brightness is reproduced with respect to the original video signal Video in a liquid crystal display.

Two systems of data latch circuits 143*b* and 143*c* for latching the output signal of the gamma correction circuit 142 are connected to the output side of the gamma correction circuit 142. A buffer amplifier circuit 145*b* is connected to the output side of the data latch circuit 143*b* through a D/A conversion circuit 144*b*, and a buffer amplifier circuit 145*c* is connected to the output side of the data latch circuit 143*c* through a D/A conversion circuit 144*c*. Moreover, a gain-offset correction circuit 146, which corrects the level difference between two systems of video signals VideoI and VideoII based upon video signals VideoI and VideoII that are the outputs of the buffer amplifiers 145*b* and 145*c*, is provided.

FIG. 21 shows a timing chart which indicates the operation of the video-signal forming circuit. Referring to FIG. 21, an explanation will be given of the operation of the video signal forming circuit.

First, an original video signal Video is inputted to the A/D conversion circuit 141, and the A/D conversion circuit 141 A/D converts the inputted original video signal Video, as well as sampling it during the sampling period t0 as shown in FIG. 21, thereby outputting the video signal electric potentials $D_1$, $D_2$, . . . , etc. The output from the A/D conversion circuit 141 is inputted to the gamma correction circuit 142 where it is subjected to a gamma correction.

Next, the output of the gamma correction circuit 141 is inputted to the two systems of data latch circuits 143*b* and 143*c*. In the two systems of data latch circuits 143*b* and 143*c*, the video signal electric potentials $D_1$, $D_2$ . . . , etc. are latched with a period two times the sampling period t0 by clock signals CKb and CKc whose phases are mutually shifted by the sampling period t0. At this time, as shown in the Figure, the odd-numbered video signal electric potentials $D_1$, $D_3$, . . . , etc. are latched into the data latch circuit 143*b*, and as shown in the Figure, the even-numbered video signal electric potentials $D_2$, $D_4$, . . . , etc. are latched into the data latch circuit 143*c*.

The outputs of the two systems of data latch circuits 143*b* and 143*c* are inputted to the corresponding D/A conversion circuits 144*b* and 144*c*. The D/A conversion circuits 144*b* and 144*c* are driven by the clock signals CKd and CKe, with the result that the video signal electric potentials $D_1$, $D_2$, . . . , etc. are inputted to the respective buffer amplifier circuits 145*b* and 145*c* in timing whose phases are mutually shifted by the sampling period t0.

In this manner, the above-mentioned two kinds of video signals VideoI and VideoII are obtained.

The above-mentioned conventional active-matrix-type liquid crystal display of the driving-circuit built-in type has a structure in which the two shift registers SRa and SRb and the two video signal lines 131*a* and 131*b* are provided (see FIG. 18); and in this case, in the video-signal forming circuit provided on the external portion of the substrate, the data latch circuits 143*b* and 143*c*, the D/A conversion circuits 144*b* and 144*c* and the buffer amplifier circuits 145*b* and 145*c*, the numbers of which are equal to a number by which the video signal is divided (in this case, "two"), need to be installed in order to produce the two systems of video signals VideoI and VideoII (see FIG. 20).

Here, in this liquid crystal display, in the case when an image merely requiring half of the scanning frequency of the present condition is displayed, this is easily achieved by using a method in which the frequency of each of the shift clock signals $\phi A \cdot / \phi A \cdot \phi B \cdot / \phi B$ to be inputted to the shift registers SRa and SRb is reduced to half.

However, such a method for reducing the frequency of each of the shift clock signals $\phi A \cdot / \phi A \cdot \phi B \cdot / \phi B$ to half fails to provide a frequency suitable for the construction of external circuits such as the video-signal forming circuit, resulting in the following problems.

Since merely requiring half of the scanning frequency of the present condition means that it is not necessary to divide the video signal into two, it becomes possible to design a construction in which the aforementioned video-signal forming circuit, installed in the external portion of the substrate, merely requires one group of the data latch circuit, D/A conversion circuit and buffer amplifier circuit, or one buffer amplifier, so that the cost reduction can be achieved by miniaturizing the circuit scale; however, the above-mentioned method fails to cut costs because the number of systems for the video signal is not reduced.

Further, when the video signal is divided, buffer amplifiers that deal with the corresponding video signals are required, and the increased number of buffer amplifiers causes the disadvantage that stripes resulting from irregularities in offsets of the amplifiers become conspicuous; therefore, it is preferable to avoid unnecessary division of the video signal.

Therefore, the external circuits, such as the video-signal forming circuit, should be appropriately designed so as to fit the scanning frequency.

However, in contrast, in the case when the circuit construction suitable for the scanning frequency is provided, although the resulting cost reduction is achieved, the substrate for constituting the active-matrix-type liquid crystal display has to be reconstructed in its design, thereby cancelling the cost reduction effects that have been achieved.

SUMMARY OF THE INVENTION

The present invention has been devised to solve the above-mentioned problems, and its objective is to provide a driving method for an image display having the following advantages and an image display using such a driving method. In other words, even in the case where it is applied to another system using a different scanning frequency, such as in the case where, for example, a liquid crystal display, which is designed based on the XGA (extended graphics array) standard and has 1024×768 pixels, is sharedly used as a TV-image-receiving liquid crystal display for displaying a video signal of the NTSC (National Television System Committee) system, the driving method is capable of providing a shared use of a substrate and reducing the costs, while allowing the construction of the external circuit to become suitable for the different scanning frequency.

In order to achieve the above-mentioned objective, the driving method for the active-matrix-type image display of the present invention is a driving method which is provided with: a plurality of gate bus lines and a plurality of source bus lines, which are mutually orthogonalized on a substrate, and a source driving circuit for driving the source bus lines, the source driving circuit being provided with switching means formed in the respective source bus lines and opening and closing control sections for controlling the opening and closing of the respective switching means, with the respective switching means being connected to the plural video signal lines one by one in succession. The driving method for the active-matrix-type image display is characterized in that in the case when the number of divisions of the video signal is reduced in response to the scanning frequency of an original video signal, the plural video signal lines are divided into groups the number of which corresponds to the reduced number of divisions so that the same video signal is inputted to the video signal lines that belong to the same group.

In order to achieve the above-mentioned objective, the driving method for the active-matrix-type image display of the present invention is a driving method which is provided with: a plurality of gate bus lines and a plurality of source bus lines, which are mutually orthogonalized on a substrate, and a source driving circuit for driving the source bus lines, the source driving circuit being provided with a switching circuit connected to a plurality of video signal lines for transmitting a video signal. The driving method for the active-matrix-type image display is characterized in that the video signal is divided into a number corresponding to the scanning frequency of the video signal, and in the case when the number of divisions of the video signal is fewer than the number of the video signal lines, the plural video signal lines are grouped so as to form groups the number of which is equal to the number of divisions so that the same video signal is inputted to the video signal lines that belong to the same group.

With the above-mentioned driving methods, even in the case when an original video signal, which has a scanning frequency that is lower than the scanning frequency initially set at the time of the substrate design, is displayed, the number of divisions of the video signal is properly set so as to fit the low scanning frequency. In other words, the shared use of the substrate is available, the cost reduction is achieved by optimizing the external circuit construction (scale), such as that of the video-signal forming circuit, so as to fit the low scanning frequency as described in the section of the prior art, and the disadvantage of stripes, which appears due to offset irregularities of the amplifiers caused by an increase in the number of the buffer amplifier circuits, can be suppressed. As a result, it becomes possible to achieve a great reduction in costs in an active-matrix-type image display.

In the above-mentioned driving methods, if the opening and closing control sections in the source driving circuit are constituted by shift registers forming a plurality of systems, the number of divisions of a shift clock signal corresponding to the number of the systems of the shift registers may also be reduced in accordance with the number of divisions of the video signal lines so that the same driving operation can be carried out by inputting the same shift lock signal to different shift registers.

As compared with a construction for driving the shift registers individually without reducing the number of divisions of a shift clock, this arrangement makes it possible to reduce the external circuit scale, thereby further miniaturizing the external circuit scale as compared with the above-mentioned driving methods.

Moreover, in the above-mentioned driving methods, the number of divisions of a shift start signal corresponding to the number of the systems of the shift registers may also be reduced in accordance with the number of divisions of the video signal lines so that the same shift lock signal may be inputted to different shift registers.

In such a construction where the shift start signal is also divided in accordance with the number of systems of the shift registers, as compared with a construction for supplying shift start signals to individual shift registers without reducing the number of divisions of a shift start signal, it becomes possible to reduce the external circuit scale, thereby further miniaturizing the external circuit scale as compared with the above-mentioned driving methods.

Furthermore, in the above-mentioned driving methods, if the opening and closing control sections in the source driving circuit are constituted by decoder circuits forming a plurality of systems, the number of divisions of signals to be supplied to the respective decoder circuits may also be reduced in accordance with the number of divisions of the video signal lines so that the same driving operation can be carried out by inputting the same signal to different decoder circuits.

In the case when selection of the source bus lines is carried out by using decoder circuits, as compared with a construction for driving the decoder circuits individually without reducing the number of divisions of signals to be supplied to the respective decoder circuits, the driving operation as described above makes it possible to reduce the external circuit scale, thereby further miniaturizing the external circuit scale as compared with the above-mentioned driving methods.

In order to achieve the above-mentioned objective, the active-matrix-type image display of the present invention is. an image display which is provided with: a plurality of gate bus lines and a plurality of source bus lines, which are mutually orthogonalized on a substrate, and a source driving circuit for driving the source bus lines, the source driving circuit being provided with switching means formed in the respective source bus lines and opening and closing control sections for controlling the opening and closing of the respective switching means, with the respective switching means being connected to the plural video signal lines one by one in succession. The active-matrix-type image display is characterized in that it is further provided with a first switching means for making switchovers between a state in which the plural video signal lines are disconnected from each other so that discrete video signals are transmitted and a state in which predetermined video signal lines, selected among the plural video signal lines, are connected to each other so that the same video signal is transmitted in the predetermined video signal lines.

In order to achieve the above-mentioned objective, the active-matrix-type image display of the present invention is an image display which is provided with: a plurality of gate bus lines and a plurality of source bus lines, which are mutually orthogonalized on a substrate, and a source driving circuit for driving the source bus lines, the source driving circuit being provided with a switching circuit connected to a plurality of video signal lines for transmitting a video signal. The active-matrix-type image display is characterized in that it is further provided with a first switching means for making switchovers between a state in which the video signal lines are mutually disconnected so as to transmit discrete video signals in accordance with the scanning frequency of a video signal and a state in which predetermined video signal lines, selected among the plural video signal lines, are connected so as to transmit the same video signal in the predetermined video signal lines.

With the above-mentioned arrangement, since the first switching means provides the state in which the predetermined video signal lines are mutually connected when occasion calls, the active-matrix-type image display can be used for displaying an original video signal having a scanning frequency lower than the scanning frequency as designed a and when the driving method of the present invention is carried out, it becomes possible to reduce the number of input signals to the source driving circuit. Therefore, reliability is improved in making connection between the substrate and an external device. Consequently, it becomes possible to provide an active-matrix-type image display in which the driving method of the present invention is preferably adopted.

In the active-matrix-type image display of the present invention, it is preferable to further provide an arrangement in which: the opening and closing control section of the source driving circuit is constituted by shift registers forming a plurality of systems, and a second switching means, which makes switchovers between a state in which a plurality of shift clock signal lines, which supply shift clock signals to the shift registers, are mutually disconnected so as to transmit discrete shift clock signals and a state in which predetermined shift clock signal lines, selected among the plural shift clock signal lines, are connected so as to transmit the same shift clock signal in the predetermined shift clock signal lines, is installed.

With the above-mentioned arrangement, since the second switching means provides the state in which the predetermined shift clock signal lines are mutually connected when occasion calls, the active-matrix-type image display can be used for displaying an original video signal having a scanning frequency lower than the scanning frequency as designed, and when the driving method of the present invention is carried out, it becomes possible to reduce the number of input signals to the source driving circuit. Therefore, reliability is improved in making connection between the substrate and an external device. Consequently, it becomes possible to provide an active-matrix-type image display in which the driving method of the present invention is preferably adopted.

In the active-matrix-type image display of the present invention, it is preferable to further provide a third switching means which makes switchovers between a state in which a plurality of shift start signal lines, which supply shift start signals to the shift registers, are mutually disconnected so as to transmit discrete shift start signals and a state in which predetermined shift start signal lines, selected among the plural shift start signal lines, are connected so as to transmit the same shift start signal in the predetermined shift start signal lines.

With the above-mentioned arrangement, since the third switching means provides the state in which the predetermined shift start signal lines are mutually connected when occasion calls, the active-matrix-type image display can be used for displaying an original video signal having a scanning frequency lower than the scanning frequency as designed, and when the driving method of the present invention is carried out, it becomes possible to reduce the number of input signals to the source driving circuit. Therefore, reliability is improved in making connection between the substrate and an external device. Consequently, it becomes possible to provide an active-matrix-type image display in which the driving method of the present invention is preferably adopted.

In the active-matrix-type image display of the present invention, it is preferable to further provide an arrangement in which: the opening and closing control section of the source driving circuit is constituted by decoder circuits forming a plurality of systems, and a fourth switching means, which makes switchovers between a state in which a plurality of signal lines, which supply signals to the decoder circuits, are mutually disconnected so as to transmit discrete signals and a state in which predetermined signal lines, selected among the plural of signal lines, are connected so as to transmit the same signal in the predetermined signal lines, is installed.

With the above-mentioned arrangement, since the fourth switching means provides the state in which the predetermined signal lines are mutually connected when occasion calls, the active-matrix-type image display can be used for displaying an original video signal having a scanning frequency lower than the scanning frequency as designed, and when the driving method of the present invention is carried out, it becomes possible to reduce the number of input signals to the source driving circuit. Therefore, reliability is improved in making connection between the substrate and an external device. Consequently, it becomes possible to provide an active-matrix-type image display in which the driving method of the present invention is preferably adopted.

The active-matrix-type image display of the present invention is characterized in that the circuit constituting the above-mentioned switching means (the first through fourth switching means), the source driving circuit and the gate driving circuit for driving the gate bus lines are formed on the same substrate that is provided with the source bus lines and gate bus lines.

With the above-mentioned arrangement, as compared with an arrangement in which the circuit constituting switching means, the source driving circuit and the gate driving circuit for driving the gate bus lines are formed outside the substrate that is provided with the source bus lines and the gate bus lines, it is possible to reduce the manufacturing costs. Consequently, it becomes possible to reduce the price of an active-matrix-type image display.

Other objects and advantages of the present invention will become apparent upon reading the following detailed description and upon reference to the drawings in which:

DESCRIPTION OF THE EMBODIMENTS

[Embodiment 1]

The following description will discuss one embodiment of the present invention.

Figure 1:
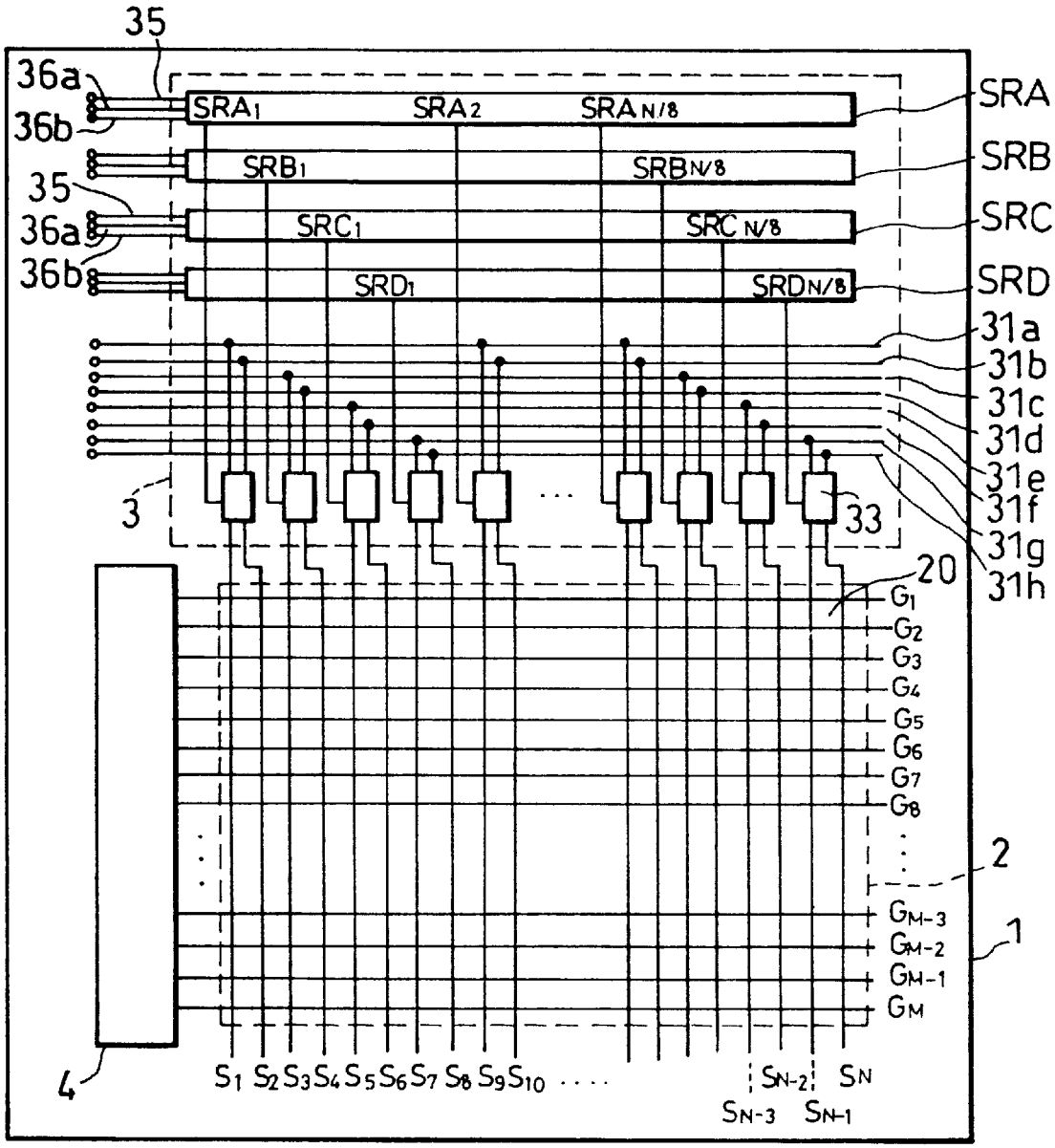
FIG. 1, which shows one embodiment of the present invention, is a circuit diagram of an active-matrix-type liquid crystal display.

FIG. 1 shows an active-matrix-type liquid crystal display of a driving-circuit built-in type having video signal lines of a plurality of systems, which is related to the present embodiment. Referring to FIG. 1, an explanation will be given of a construction of the active-matrix-type liquid crystal display (hereinafter, referred to simply as a liquid crystal display) of the driving-circuit built-in type of the present embodiment.

As illustrated in FIG. 1, in this liquid crystal display, source bus lines $S_1$ through $S_N$ and gate bus lines $G_1$ through $G_M$ are wired in warp and woof on an insulating substrate 1 (hereinafter, referred to as a substrate) so that a display section 2 is formed. On the substrate 1 on which the display section 2 is formed, a source driver 3 (a source driving circuit) for driving the source bus lines $S_1$ through $S_N$ is formed at one end of the source bus lines $S_1$ through $S_N$ and a gate driver 4 (a gate driving circuit) for driving the gate bus lines $G_1$ through $G_M$ is formed at one end of the gate bus lines $G_1$ through $G_M$. The source driver 3 and the gate driver 4 are formed on the substrate 1 on which the source bus lines $S_1$ through $S_N$, the gate bus lines $G_1$ through $G_M$ and pixels 20 are provided.

Figure 2:
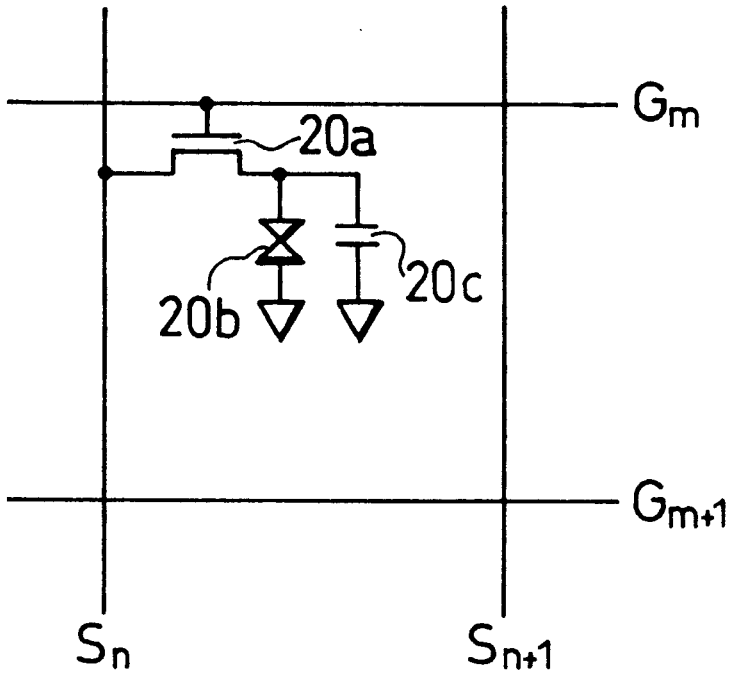
FIG. 2 is an equivalent circuit diagram of a pixel shown in FIG. 1.

In the display section 2, each of portions, surrounded by the source bus lines $S_n$ ($1 \leqq n \leqq N$) and the gate bus lines $G_m$ ($1 \leqq m \leqq M$)Sn, forms a pixel 20 which is one unit of display. The pixel 20, which has the same construction as the pixel shown in FIG. 2, is constituted by a thin-film transistor 20*a* functioning as a switching element that is formed at an intersecting point between each source bus line $S_n$ and each gate bus line $G_m$, a pixel electrode 20*b* to which video-signal electric potentials are applied from the source bus lines $S_n$ so as to drive the liquid crystal capacitor and a charge-holding capacitor 20*c* installed in parallel with the pixel electrode 20*b*.

As illustrated in FIG. 1, the source driver 3 is constituted by eight video signal lines 31*a* through 31*h* (indicated by 31 when an arbitrary video signal line is referred to) for inputting video signals to the source bus lines $S_1$ through $S_N$, "N/2" number of sampling circuits 33 that are formed between the video signal lines 31*a* through 31*h* and the source bus lines $S_1$ through $S_N$ in association with every two source bus lines $S_1$ through $S_N$, and shift registers SRA, SRB, SRC and SRD serving as a shift register section that controls the operation of the sampling circuits 33.

The source bus lines $S_{1+8k}$(k=0, 1, 2, . . . , etc.) are connected to video signal line 31*a*, the source bus lines $S_{2+8k}$(k=0, 1, 2, . . . , etc.) are connected to video signal line 31*b*, the source bus lines $S_{3+8k}$(k=0, 1, 2, . . . , etc.) are connected to video signal 31*c*, and the source bus lines $S_{4+8k}$(k=0, 1, 2, . . . , etc.) are connected to video signal line 31*d* respectively. Further, the source bus lines $S_{6+8k}$(k=0, 1, 2, . . . , etc.) are connected to video signal line 31*e*, the source bus lines $S_{6+8k}$(k=0, 1, 2, . . . , etc.) are connected to video signal line 31*f*, the source bus lines $S_{7+8k}$(k=0, 1, 2, . . . , etc.) are connected to video signal line 31*g*, and the source bus lines $S_{8+8k}$(k=0, 1, 2, . . . , etc.) are connected to video signal line 31*h* respectively.

Figure 3:
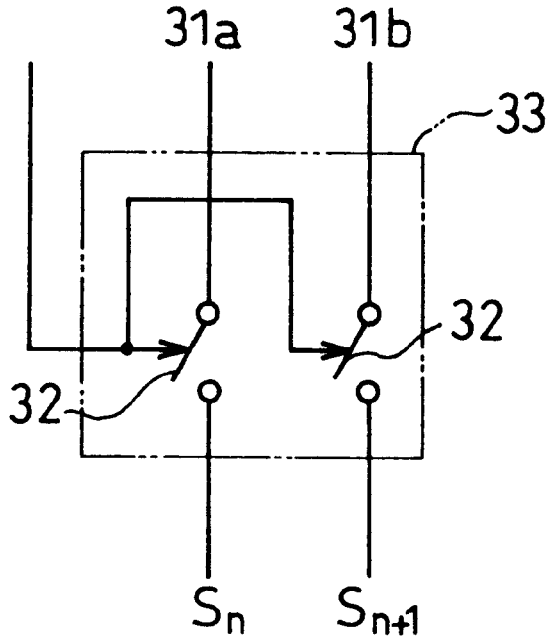
FIG. 3 is a circuit diagram of a sampling circuit as shown in FIG. 1.

As illustrated in FIG. 3, one sampling circuit 33 is constituted by two analog switches 32 that are formed between two video signal 31*a* and 31*b*, 31*c* and 31*d*, 31*e* and 31*f*, or 31*g* and 31*h* and two source bus lines $S_n$ and $S_{n+1}$. Here, in FIG. 3, only a construction related to two video signal lines 31*a* and 31*b* is shown. The analog switches 32 are respectively installed between video signal lines 31*a* through 31*h* and the source bus lines $S_1$ through $S_N$ in order to sample video signals to be inputted to video signal lines 31*a* through 31*h*.

Four systems of shift registers SRA through SRD control the respective sampling circuits 33, each of which is connected with two adjacent source bus lines $S_1$ through $S_N$. The adjacent sampling circuits 33 are driven by those shift registers SRA, SRB, SRC and SRD belonging to different systems. By the driving operations of those shift registers SRA, SRB, SRC and SRD, the opening and closing operations of two analog switches 32 constituting the sampling circuit 33 are carried out at the same time.

As shown in FIG. 1, to each of four systems of shift registers SRA through SRD are connected shift clock signal lines 36*a* and 36*b* for inputting shift clock signals of two types having mutually reversed phases and a shift start signal line 35 for inputting a shift start signal.

Figure 4:
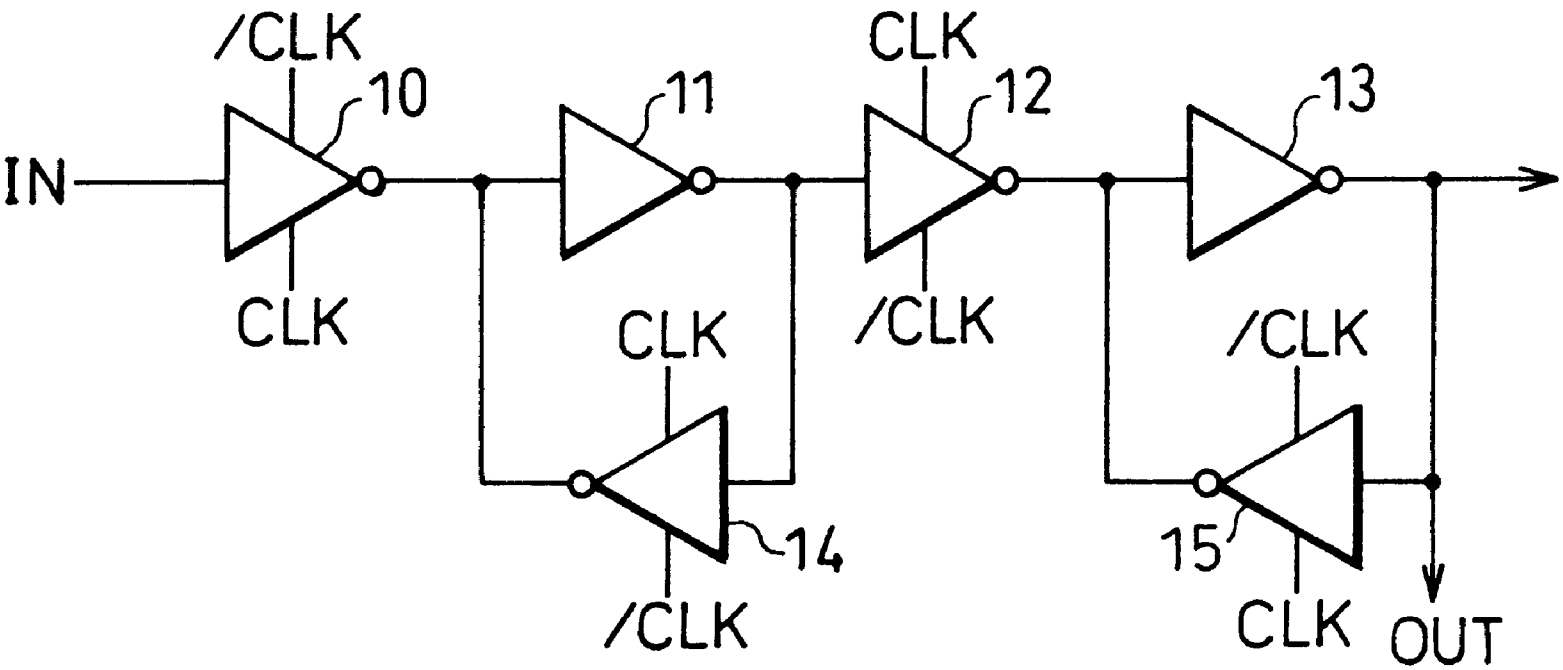
FIG. 4 is a circuit diagram of a shift register as shown in FIG. 1.

FIG. 4 shows a circuit diagram of the shift register that constitutes each of shift registers SRA through SRD. As illustrated in FIG. 4, the shift register of one stage is constituted by six inverters 10 through 15. A shift clock signal (indicated by CLK in the Figure) and another shift clock signal having the reversed phase to the clock signal CLK (indicated by /CLK in the Figure) are inputted to inverters 10, 12, 14 and 15. Inverters 10, 12, 14 and 15 shift data (corresponding to the shift start signal in the case of the first stage) that has been inputted from the shift register at the preceding stage by one period of the shift clock signal, and output the resulting data. In this case, as illustrated in FIG. 1, since four systems of shift registers SRA through SRD are installed and since the two analog switches 32 connected to two source bus lines $S_n$ and $S_{n+1}$ are controlled to be driven at the same time, each system of shift registers SRA through SRD has N/8 stages.

Next, in the liquid crystal display having the above-mentioned arrangement, explanations will be given of driving operations for displaying two kinds of original video signals, Video and Video', having mutually different scanning frequencies.

Figure 5:
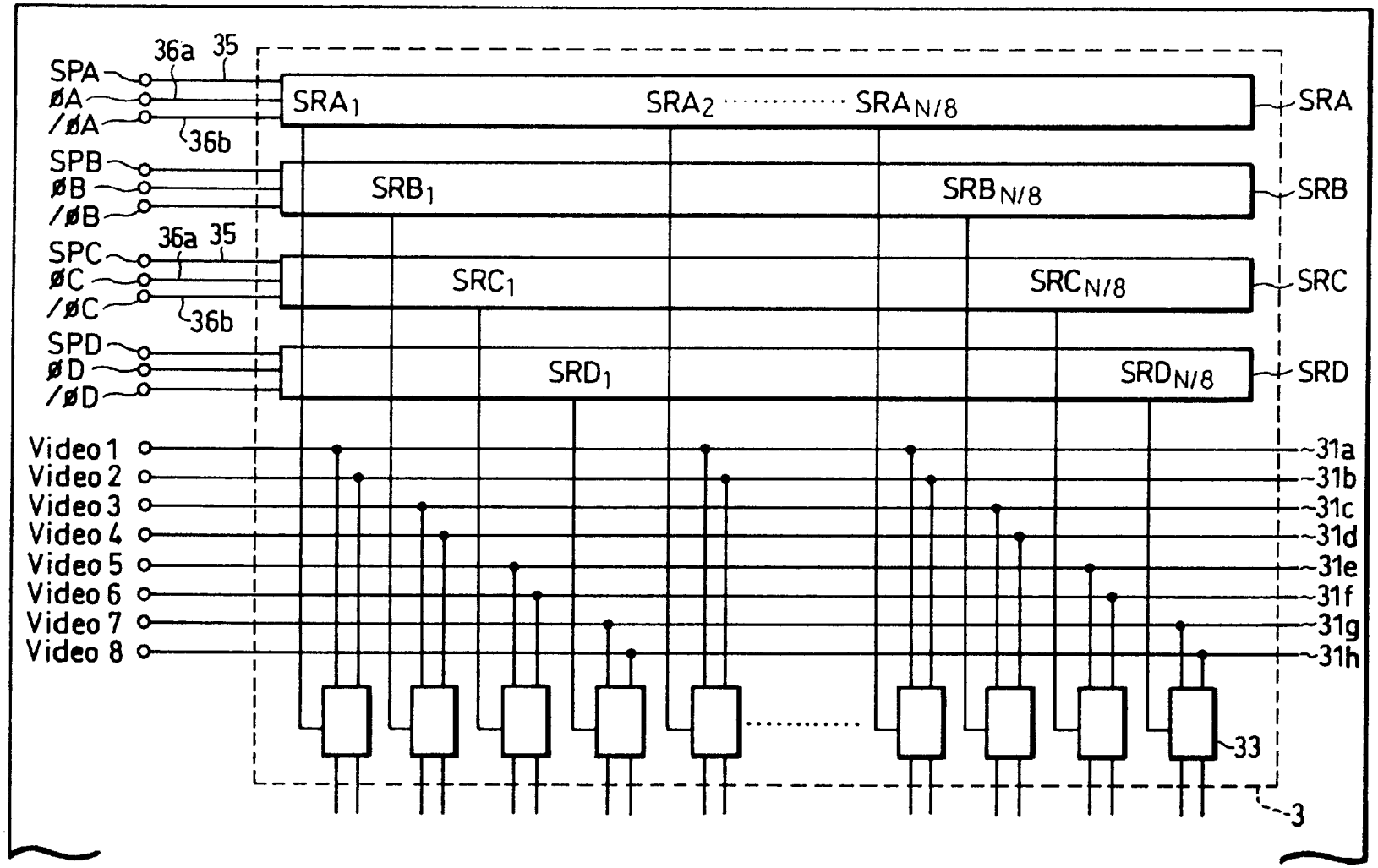
FIG. 5 is an explanatory drawing that shows signal inputs to a source driver in the case when eight systems of video signals are inputted to eight video signal lines in the active-matrix-type liquid crystal display of FIG. 1.

1) First, referring to FIG. 5, the following description will discuss one of the driving operations in which an original video signal Video having a scanning frequency as originally designed is used, and discrete video signals Video are respectively inputted to eight video signal lines 31*a* through 31*h* as was designed.

As illustrated in FIG. 5, eight video signals Video 1 through Video 8, which have been formed by dividing the video signal Video by 8 in the video-signal forming circuit as explained in the aforementioned prior-art section, are inputted to eight video signal lines 31*a* through 31*h*. Shift clock signals $\phi A \cdot /\phi A$ of $\alpha$ MHz having mutually reversed phases are inputted to shift register SRA, shift clock signals $\phi B \cdot /\phi B$ of $\alpha$ MHz having mutually reversed phases are inputted to shift register SRB, shift clock signals $\phi C \cdot /\phi C$ of $\alpha$ MHz having mutually reversed phases are inputted to shift register SRC, and shift clock signals $\phi D \cdot /\phi D$ of $\alpha$ MHz having mutually reversed phases are inputted to shift register SRD, respectively. Further, shift start signals SPA through SPD are also inputted to the respective four systems of shift registers SRA through SRD.

Figure 6:
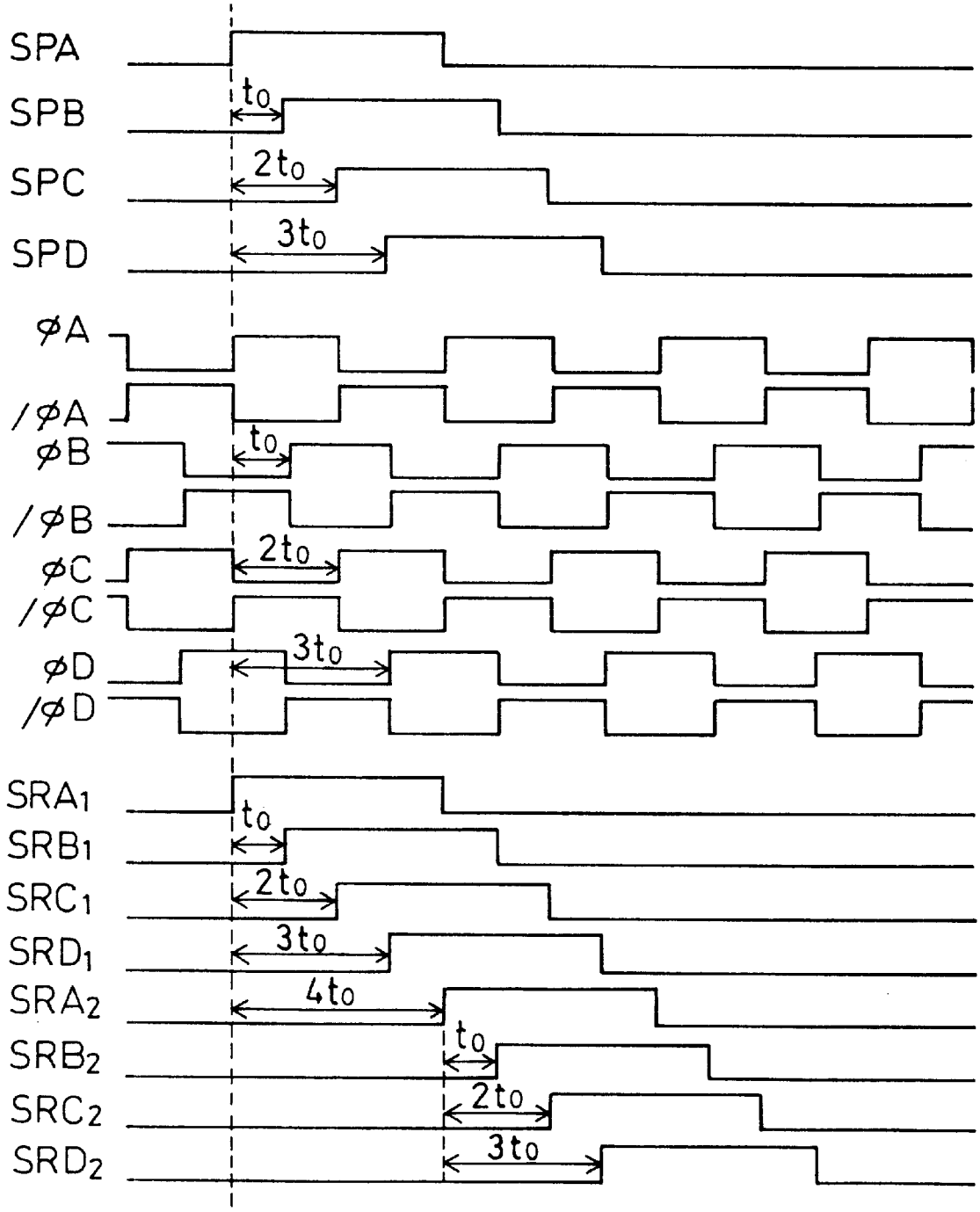
FIG. 6 is a timing chart of the source driver in the case when the eight systems of video signals are inputted and driven in the active-matrix-type liquid crystal display of FIG. 1.

FIG. 6 shows the phases of shift clock signals $\phi A \cdot /\phi A \cdot \phi B \cdot /\phi B \cdot \phi C \cdot /\phi C \cdot \phi D \cdot /\phi D$ and the phases of shift start signals SPA through SPD. Shift clock signals $\phi A \cdot \phi B \cdot \phi C \cdot \phi D \cdot /\phi D$ have their phases successively shifted by the sampling period $t_0$ of the original video signal Video corresponding to a ¼ period (by the value obtained by dividing the effective horizontal scanning period by the number of the effective source bus lines). Shift start signals SPB through SPD also have their phases successively shifted by $t_0$.

Based upon such shift clock signals $\phi A \cdot /\phi A \cdot \phi B \cdot /\phi B \phi C \cdot /\phi C \cdot \phi D \cdot /\phi D$, four systems of shift registers SRA through SRD successively output waveforms having their phase successively shifted by $t_0$ to the sampling circuit 33. Thus, the two analog switches 32, which constitute the sampling circuit 33, are allowed to conduct for period $4t_0$ at the same time so as to sample data of the two video signal lines 31, thereby successively driving source bus lines $S_1$ through $S_N$ two by two.

Figure 7:
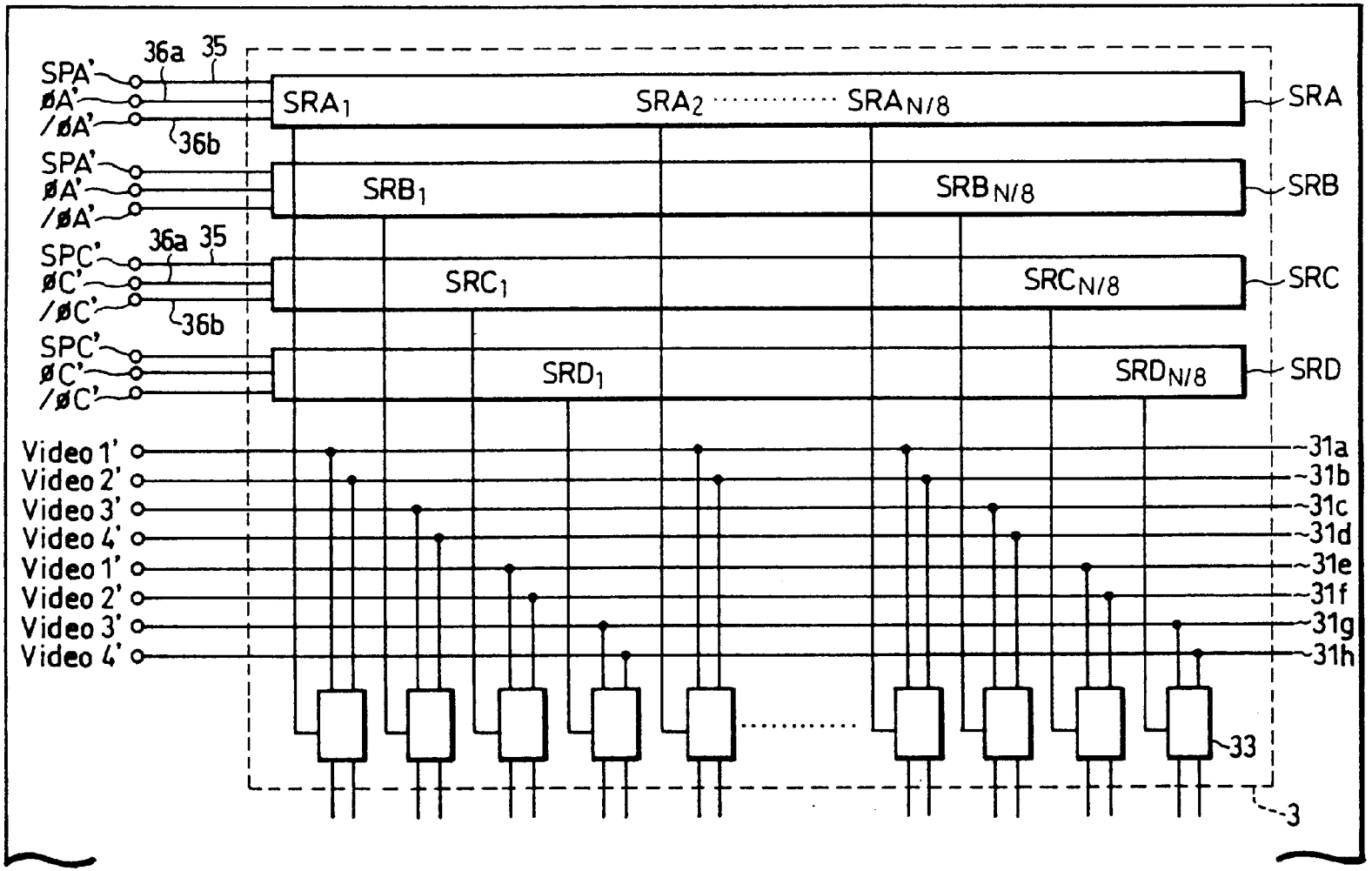
FIG. 7 is an explanatory drawing that shows signal inputs to a source driver in the case when four systems of video signals are inputted to eight video signal lines in the active-matrix-type liquid crystal display of FIG. 1.

2) Next, referring to FIG. 7, the following description will discuss the other driving operation in which an original video signal Video' having a scanning frequency of half the scanning frequency as originally designed is displayed.

In this case, the original video signal Video' is divided into four video signals Video 1' through Video 4' by the video-signal forming circuit in accordance with the scanning frequency. Simultaneously, as illustrated in FIG. 7, eight video signal lines 31*a* through 31*h* are grouped so as to form four groups, that is, video signal lines 31*a* and 31*e*, video signal lines 31*b* and 31*f*, video signal lines 31*c* and 31*g* as well as video signal lines 31*d* and 31*h*, each group consisting of two lines. Then, the same video signal is inputted to the video signal lines that belong to the same group. In other words, Video 1' is inputted to video signal lines 31*a* and 31*e*, Video 2' is inputted to video signal lines 31*b* and 31*f*, Video 3' is inputted to video signal lines 31*c* and 31*g*, and Video 4' is inputted to video signal lines 31*d* and 31*h*.

Figure 8:
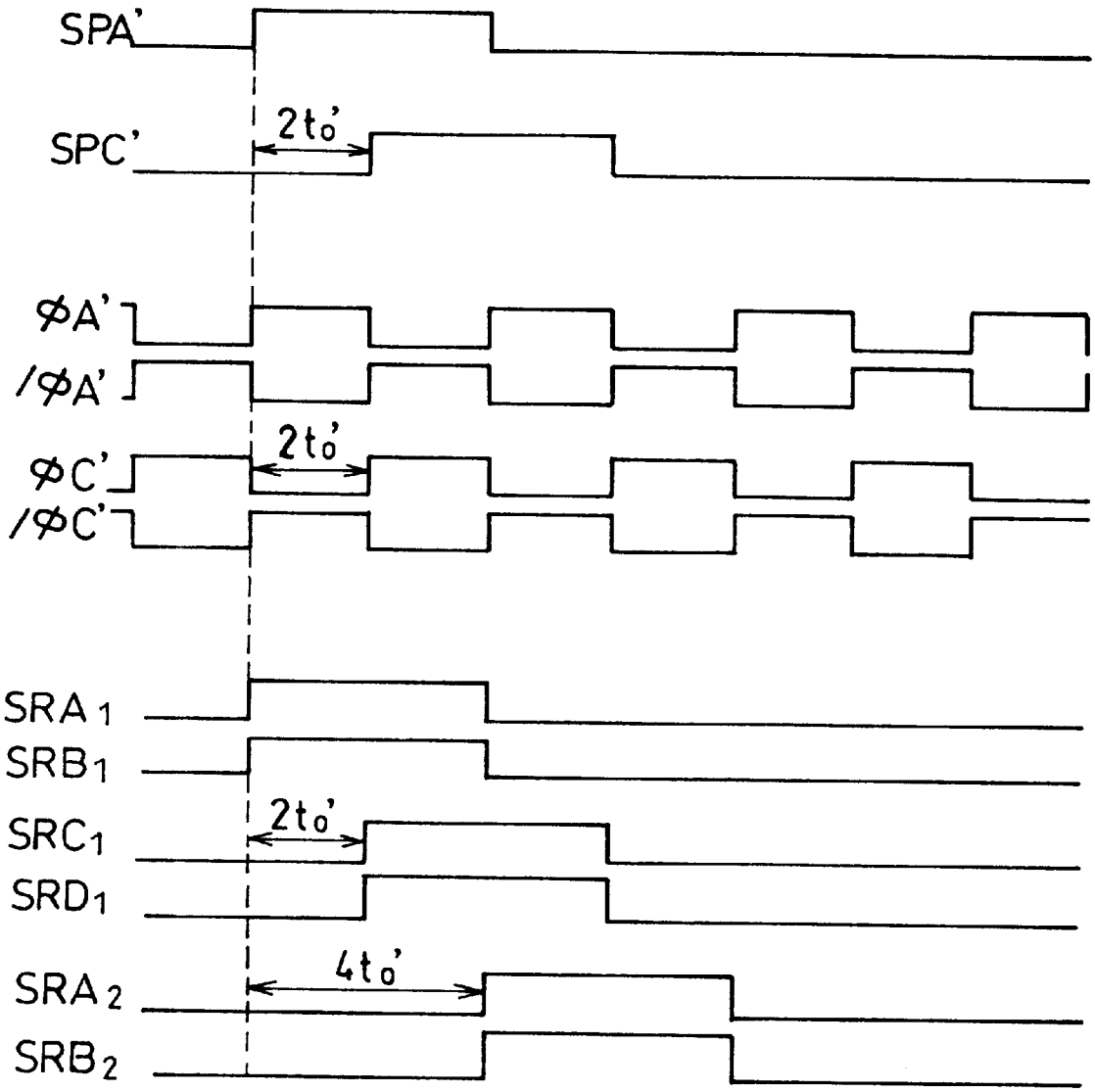
FIG. 8 is a timing chart of the source driver in the case when the four systems of video signals are inputted and driven in the active-matrix-type liquid crystal display of FIG. 1.

Then, shift clock signals $\phi A' \cdot /\phi A'$ are inputted to shift registers SRA and SRB, and shift clock signals $\phi C' \cdot /\phi C'$, whose phases are different from those of shift clock signals $\phi A' \cdot /\phi A'$ by $2t_0'$, are inputted to shift registers SRC and SRD (see FIG. 8). Further, shift start signal SPA' is inputted to shift registers SRA and SRB, and shift start signal SPC', whose phase is different from that of shift start signal SPA' by $2t_0'$, is inputted to shift registers SRC and SRD.

Here, $t_0'$ is the sampling period of the original video signal Video' (the value obtained by dividing the effective horizontal scanning period by the number of the effective source bus lines). Further, shift clock signals $\phi A'/\phi A'$ have the same phase and period as shift clock signals $\phi A/\phi A$ with merely different periods. The same is true for other shift clock signals and shift start signals.

Based upon these shift clock signals $\phi A' \cdot /\phi A' \cdot C' \cdot /\phi C'$, shift registers SRA and SRB are driven in the same manner and shift registers SRC and SRD are driven in the same manner, among four systems of shift registers SRA through SRD. The group of shift registers SRA and SRB and the group of shift registers SRC and SRD successively output waveforms with their phase mutually shifted by $2t_0'$ to the sampling circuit 33 (see FIG. 8).

Figure 9A:
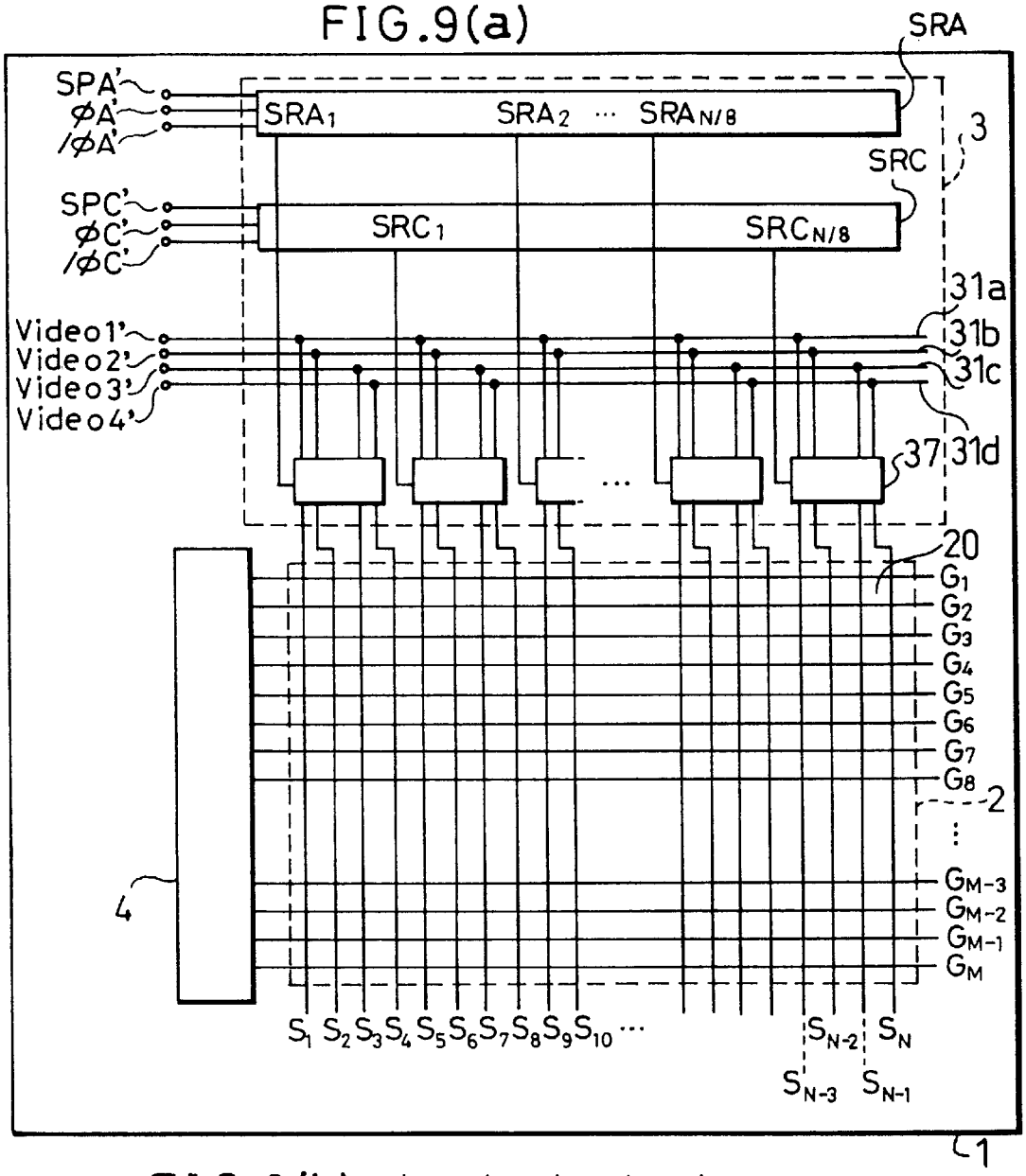
FIGS. 9(*a*) and 9(*b*) are circuit diagrams of a pseudo active-matrix-type liquid crystal display to which the active-matrix-type liquid crystal display of FIG. 1 becomes equivalent by the respective signal inputs to the source driver shown in FIG. 7.
Figure 9B:
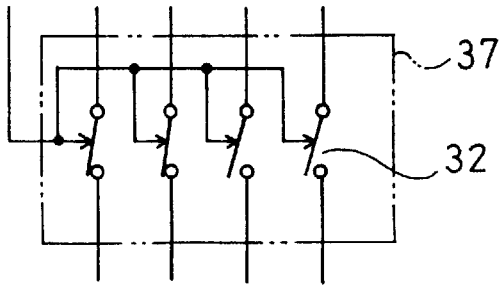

With this arrangement, since the adjacent two sampling circuits 33 are driven in the same manner, it is possible to provide the same driving operation as that of the liquid crystal display shown in FIG. 9(*a*) in which: four video signal lines 31*a* through 31*d* are provided, four video signals Video 1' through Video 4' are received from four video signal lines 31*a* through 31*d*, and a driving operation is carried out so that the video signals are simultaneously sampled four by four by the sampling circuit 37 consisting of four adjacent analog switches 32 as shown in FIG. 9(*b*).

In this case, the numbers of respective data latch circuits, D/A conversion circuits and buffer amplifier circuits, which are required for the video-signal forming circuit for forming four video signals Video 1' through Video 4' by dividing the original video signal Video' by four, are respectively only four; therefore, it is possible to reduce the cost by simplifying the circuit construction for forming the video signals, and also to prevent degradation in the display quality resulting from stripes that appear due to offset irregularities caused by an increase in the number of the buffer amplifier circuits.

As described above, in the driving method of the liquid crystal display of the present invention, even in the case when an original video signal, which has a scanning frequency that is lower than the scanning frequency as initially designed, is displayed, the video signal lines 31 are divided into groups suitable for the number of divisions of the video signal corresponding to the low scanning frequency, and the same video signal is inputted to the same group of the video signal lines 31. Thus, the external circuits, such as the original video signal forming circuit, can be simplified to a construction suitable for the scanning frequency of the original video signal, thereby achieving a cost reduction. Moreover, the shared use of the substrate is available even in the case of different scanning frequencies, thereby further achieving reduction in costs, such as designing costs for new substrates, can also be achieved.

Moreover, in this arrangement, in addition to grouping of the video signal lines, a plurality of systems of shift registers SRA through SRD, which constitute the source driver 3, are also grouped, and the same shift clock signals $\phi A \cdot / \phi A$ and the same shift clock signals $\phi C \cdot / \phi C$, as well as the same shift start signal SPA and the same shift start signal SPC, are respectively inputted to shift registers SRA and SRB of the same group and shift registers SRC and SRD of the same group, so as to provide the same driving operation.

This arrangement makes it possible to further miniaturize the external circuit scale as compared with a construction in which shift registers SRA through SRD are individually driven without reducing the number of divisions of shift clock signals and shift start signals, thereby further reducing the external circuit scale as compared with a construction in which only video signal lines 31*a* through 31*h* are grouped.

Here, the number of divisions of shift clock signals and shift start signals is not necessarily reduced, and the above-mentioned driving operation can be realized by using the number of divisions as it is. Further, as compared with a case of a reduced number of divisions, this case has the advantage of low power consumption since the frequency of the shift clock signal is reduced.

Upon designing the substrate, supposing that the total number of the video signal lines is F (8 in the above-mentioned case), the number of video signal lines to be simultaneously sampled is P (2 in the above-mentioned case) and the number of divisions of a shift clock signal to be inputted to the shift register section is X (4 in the above-mentioned case), such a driving method can be achieved if $F>P\geqq 1$ and $F\geqq X>1$ are satisfied under the condition that F, P and X are integral numbers.

Here, in order to construct desirable external circuits such as the video-signal forming circuit, it is preferable to set F, P and X as values obtained by raising 2 to the j-th power ($j\geqq 2$) or multiplying 2 to the h-th power by 3, in which $X=F/P$ is satisfied.

Additionally, the present embodiment was discussed by exemplifying an active-matrix-type liquid crystal display of a driving-circuit built-in type in which the source driver 3 and the gate driver 4 are monolithically formed on the substrate 1; however, the image display of the present invention is not intended to be limited by such a driving-circuit built-in type liquid crystal display and by an image display using liquid crystal.

[EMBODIMENT 2]

Figure 10:
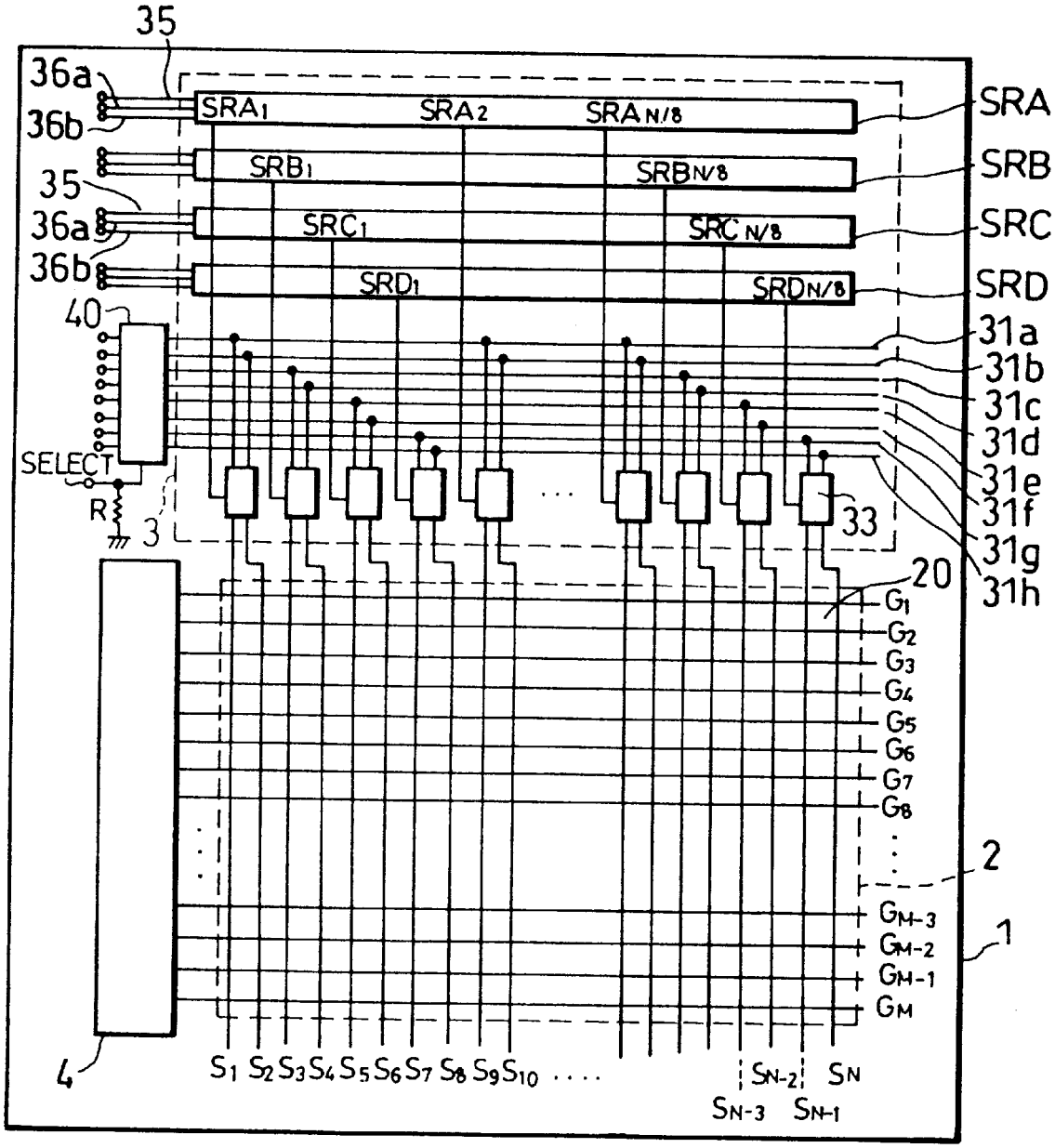
FIG. 10, which shows another embodiment of the present invention, is a circuit diagram of an active-matrix-type liquid crystal display.
Figure 11:
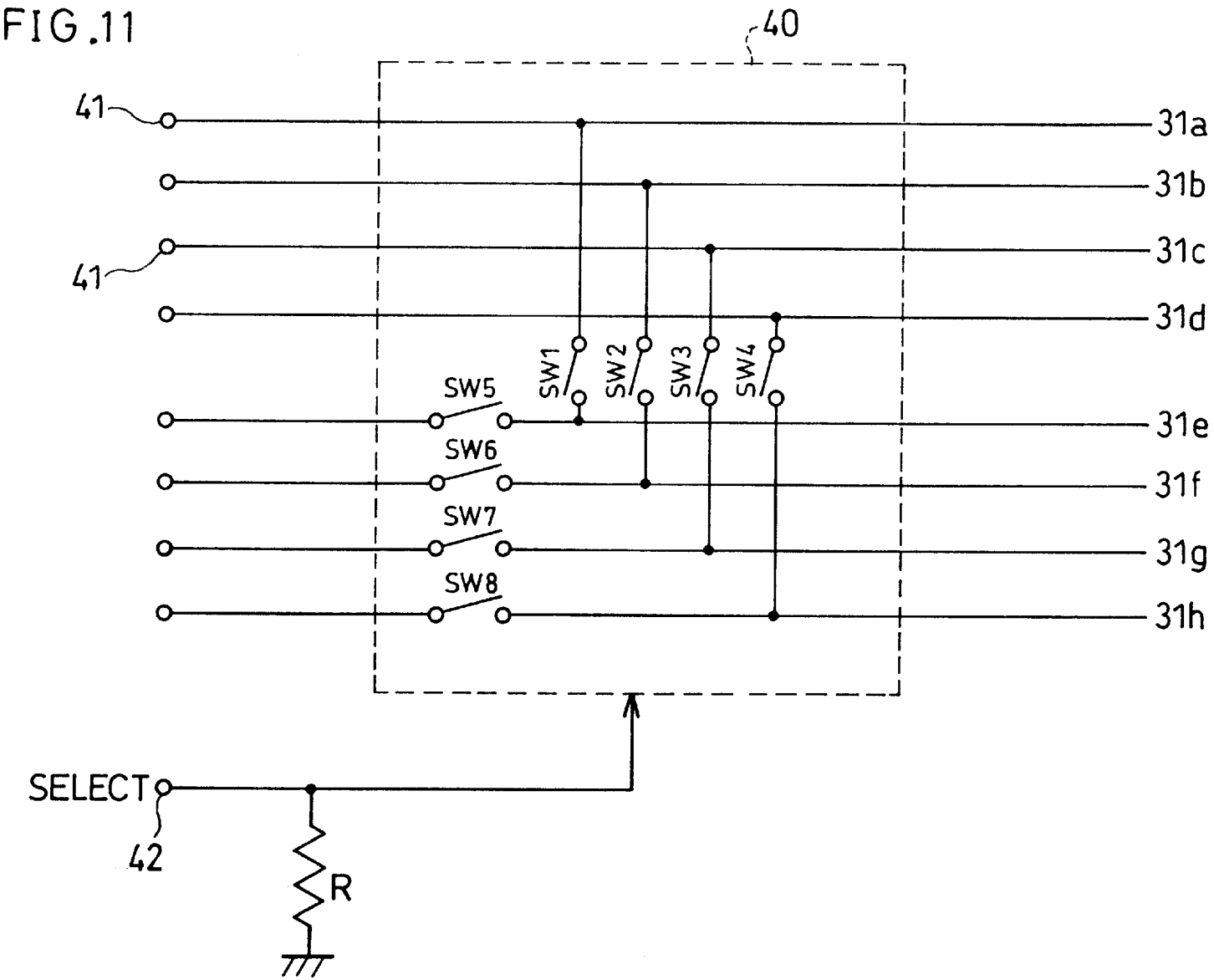
FIG. 11 is a circuit diagram of a video-signal selection circuit that is provided in the active-matrix-type liquid crystal display of FIG. 10.

Referring to FIGS. 10 and 11, the following description will discuss another embodiment of the present invention. Here, in the present embodiment, those members that have the same functions and that are described in the aforementioned embodiment are indicated by the same reference numerals and the description thereof is omitted.

In the liquid crystal display as shown in FIG. 1, the total number of input signal lines connected from outside to the source driver 3 is as many as 20, including two shift clock signal lines 36*a* and 36*b* and a shift start signal line 35 for each of the four systems of shift registers SRA through SRD and eight video signal lines 31*a* through 31*h*. The more the number of the signals inputted from outside, the more the reliability on external connection is reduced.

Therefore, as illustrated in FIG. 10, in the liquid crystal display of the present invention, a video-signal selection circuit 40 (a first switching means) is installed on the input side of eight video signal lines 31*a* through 31*h*.

FIG. 11 shows a circuit construction of the video-signal selection circuit 40. As illustrated in the Figure, the video signal selection circuit 40 is constituted by eight selection switches SW1 through SW8 that are installed between eight video signal lines 31*a* through 31*h*, and is formed on the substrate 1 on which the source driver 3 and the gate driver 4 are formed (see FIG. 10).

Switch SW1, when turned on, connects video signal line 31*a* and video signal line 31*e*, switch SW2, when turned on, connects video signal line 31*b* and video signal line 31*f*, switch SW3, when turned on, connects video signal line 31*c* and video signal line 31*g*, and switch SW4, when turned on, connects video signal line 31*d* and video signal line 31*h*.

Moreover, switches SW5 through SW8 are respectively placed on the video signal lines 31*f* through 31*h*, and when turned on, they transmit video signals inputted from the respective input terminals 41 of video signal lines 31*f* through 31*h* through the video signal lines 31*f* through 31*h*, while, when turned off, they cut off the input terminals 41 of video signal lines 31*f* through 31*h* from the respective video signal lines 31*f* through 31*h*.

Here, switch SW1 and switch SW5, switch SW2 and switch SW6, switch SW3 and switch SW7 as well as switch SW4 and switch SW8 are operated in association with each other.

The switching of each of switches SW1 through SW8 of the video signal selecting circuit 40 is carried out by a selection signal SELECT inputted from the outside of the substrate, and when the selection signal SELECT goes "high", for example, switches SW1 through SW4 are turned on, while switches SW5 through SW8 are turned off, with the result that eight video signal lines 31*a* through 31*h* are divided into four groups. In contrast, when the selection signal SELECT goes "low", switches SW1 through SW4 are turned off, while switches SW5 through SW8 are turned on, with the result that eight video signal lines 31*a* through 31*h* are separated from each other.

Further, since the video-signal selection circuit 40 is pulled down by a resistor R, it needs not to be wired to the input terminal 42 of the selection signal SELECT in the case of normal use in which image display is carried out using the scanning frequency as originally designed (in the case when different video signals are inputted to all eight video signal lines 31*a* through 31*h*).

Therefore, in the case when the number of divisions of the video signal is altered in accordance with the scanning frequency of an original video signal as described in Embodiment 1, the application of such a video signal selection circuit 40 makes it possible to connect predetermined ones of eight video signal lines 31*a* through 31*h* to each other merely by inputting the selection signal SELECT, thereby decreasing the number of input signal lines to the source driver 3 to 17.

Additionally, in the present embodiment, the video-signal selection circuits 40 are allocated only to eight video signal lines 31*a* through 31*h*; however, the same constructions may be respectively provided at the input sides of shift clock signal lines 36*a* and 36*b* and/or the shift start signal line 35 of four systems of shift registers SRA through SRD. In this case, it becomes possible to further decrease the number of signal inputs to the source driver 3, and consequently to improve the reliability.

[EMBODIMENT 3]

Referring to FIGS. 12 through 17, the following description will discuss another embodiment of the present invention. Here, for convenience of explanation, those members that have the same functions and that are described in the aforementioned embodiments 1 and 2 are indicated by the same reference numerals and the description thereof is omitted.

Figure 12:
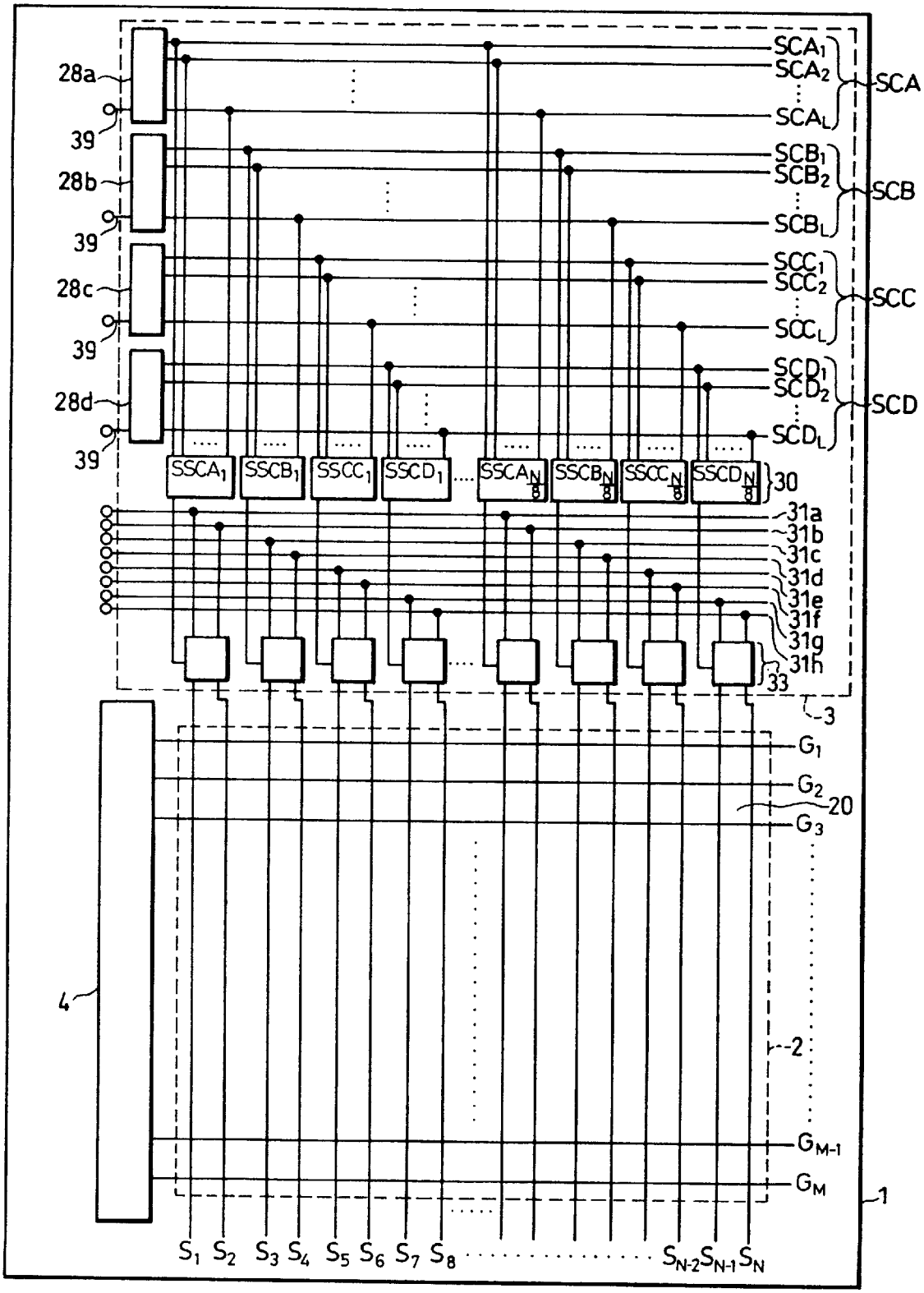
FIG. 12, which shows still another embodiment of the present invention, is a circuit diagram of an active-matrix-type liquid crystal display.

FIG. 12 shows a liquid crystal display having a plurality of systems of video signal lines of another embodiment of the present invention.

Referring to FIG. 12, the construction of the liquid crystal display of the present embodiment will be described as follows:

As illustrated in FIG. 12, instead of four systems of shift registers SRA through SRD in the source driver 3 of the liquid crystal display in Embodiment 1, this liquid crystal display is provided with: four source-bus-line selection-signal generating circuits 28*a* through 28*d* (hereinafter, referred to as selection-signal generating circuits), source-bus-line selection signal lines SCA ($SCA_1$ through $SCA_L$) through SCD ($SCD_1$ through $SCD_L$) (hereinafter, referred to as selection signal lines), each consisting of "L" number of lines connected to selection-signal generating circuits 28*a* through 28*d* (in which L stands for the number of digits when the total number N of the source bus lines S are indicated by binary numbers), and a source-bus-line selection circuit 30 (hereinafter, referred to as a selection circuit).

Selection-signal generating circuits 28*a* through 28*d* are constituted by binary counters. Clock signal lines 39 are respectively installed in selection-signal generating circuits 28*a* through 28*d*. Source-bus-line selection signals, which are generated by predetermined selection-signal generating circuits 28*a* through 28*d*, are inputted to the selection circuit 30 through selection signal lines SCA ($SCA_1$ through $SCA_L$) through SCD ($SCD_1$ through $SCD_L$).

The selection circuit 30 is constituted by four systems of decoder circuits, each consisting of N/8 number decoder circuits, corresponding to four selection-signal generating circuits 28*a* through 28*d*, and the total number of decoder circuits is represented by N/2. Thus, the selection circuit 30 includes decoder circuits $SSCA_1$ through $SSCA_{N/8}$, decoder circuits $SSCB_1$ through $SSCB_{N/8}$, decoder circuits $SSCC_1$ through $SSCC_{N/8}$ and decoder circuits $SSCD_1$ through $SSCD_{N/8}$.

Next, in the liquid crystal display having the above-mentioned arrangement, explanations will be given of driving operations for displaying two kinds of original video signals, Video and Video', having mutually different scanning frequencies.

Figure 13:
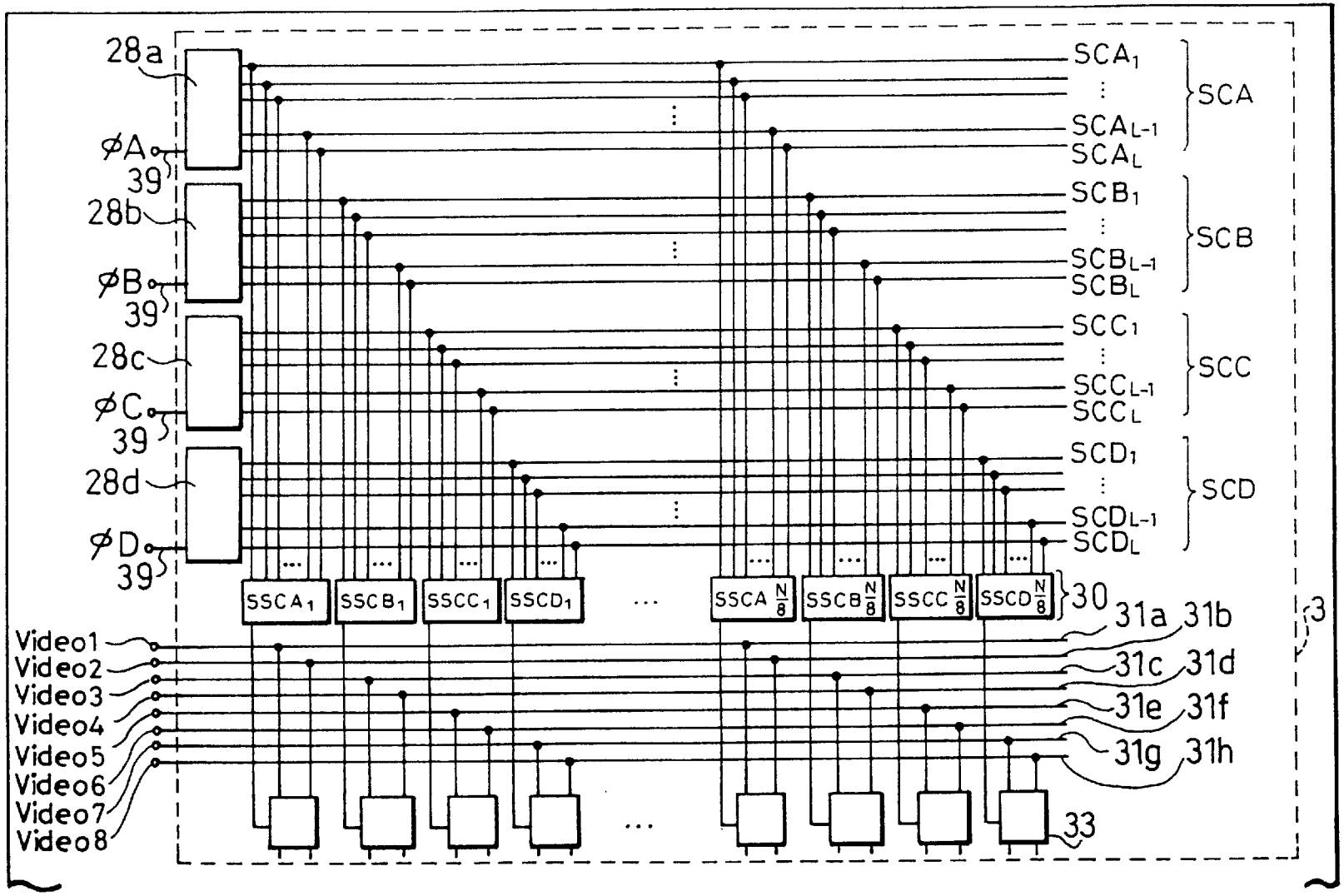
FIG. 13 is an explanatory drawing that shows signal inputs to a source driver in the case when eight systems of video signals are inputted to eight video signal lines in the-active-matrix-type liquid crystal display of FIG. 12.

1) First, referring to FIG. 13, the following description will discuss one of the driving operations in which an original video signal Video having a scanning frequency as originally designed is used, and discrete video signals Video are respectively inputted to eight video signal lines 31*a* through 31*h* as were designed.

As illustrated in FIG. 13, eight video signals Video 1 through Video 8, which have been formed by dividing the video signal Video by 8, are inputted to eight video signal lines 31*a* through 31*h*. Clock signal ϕA of α MHz is inputted to selection-signal generating circuit 28*a*, shift clock signal ϕB of α MHz is inputted to selection-signal generating circuit 28*b*, shift clock signal ϕC of α MHz is inputted to selection-signal generating circuit 28*c*, and shift clock signal ϕD of α MHz is inputted to selection-signal generating circuit 28*d*.

Figure 14:
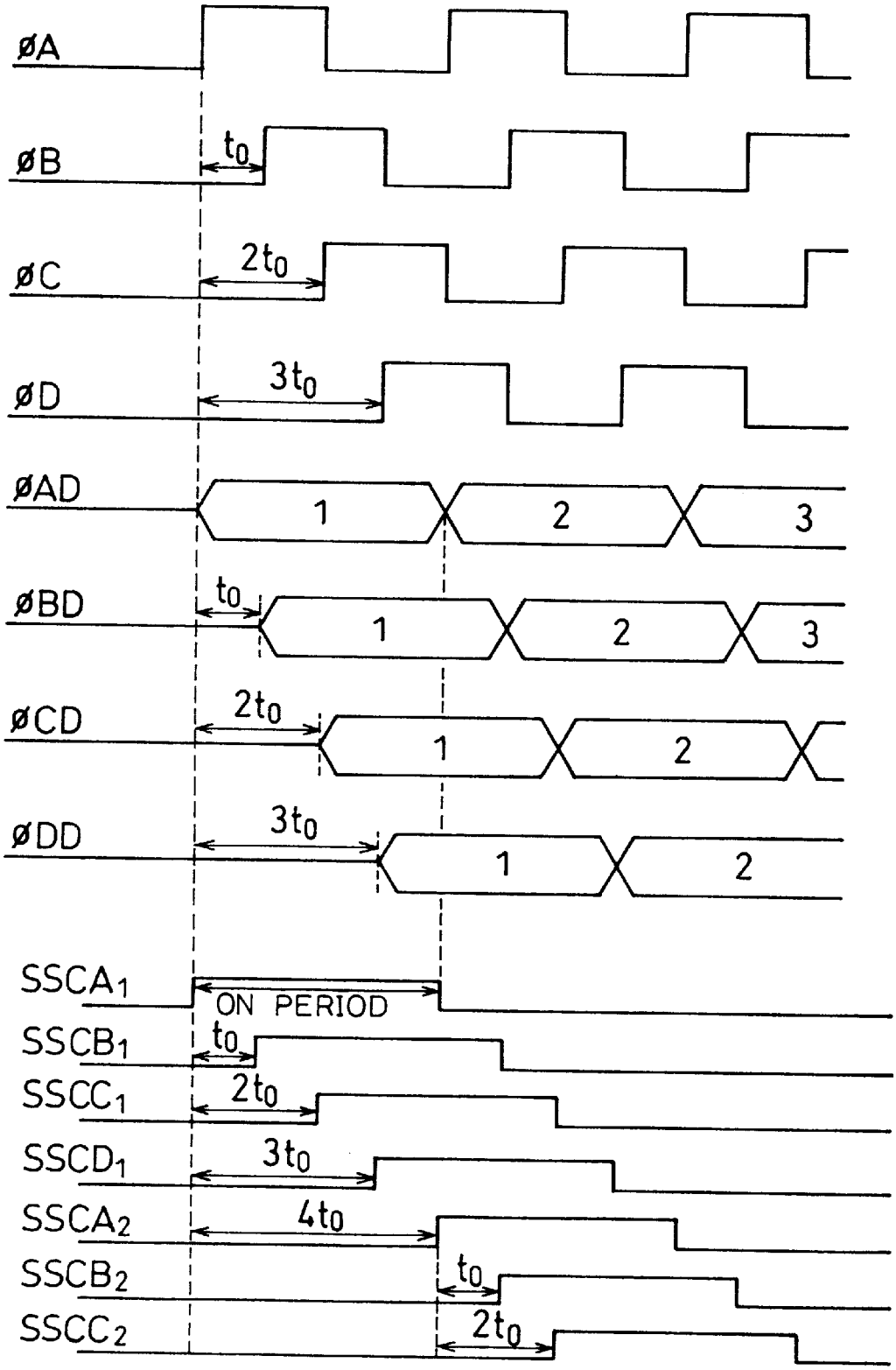
FIG. 14 is a timing chart of the source driver in the case when the eight systems of video signals are inputted and driven in the active-matrix-type liquid crystal display of FIG. 12.

FIG. 14 shows the phases of clock signals ϕA, ϕB, ϕC and ϕD. Shift clock signals ϕA, ϕB, ϕC and ϕD have their phase successively shifted by the sampling period $t_0$ of the original video signal Video corresponding to a ¼ period (by the value obtained by dividing the effective horizontal scanning period by the number of the effective source bus lines).

Based upon these clock signals ϕA, ϕB, ϕC and ϕD, four selection-signal generating circuits 28*a* through 28*d* input source-bus-line selection signals ϕAD through ϕDD shown in FIG. 14 to the respective selection circuits 30 through selection signal lines SCA through SCD.

With this arrangement, the selection circuits 30 successively output waveforms having their phase successively shifted by $t_0$ to the sampling circuit 33 (see FIG. 14). Thus, the two analog switches 32 (see FIG. 3), which constitute the sampling circuit 33, are allowed to conduct for period $4t_0$ at the same time so as to sample data of the two video signal lines, thereby successively driving source bus lines $S_1$ through $S_N$ two by two.

Figure 15:
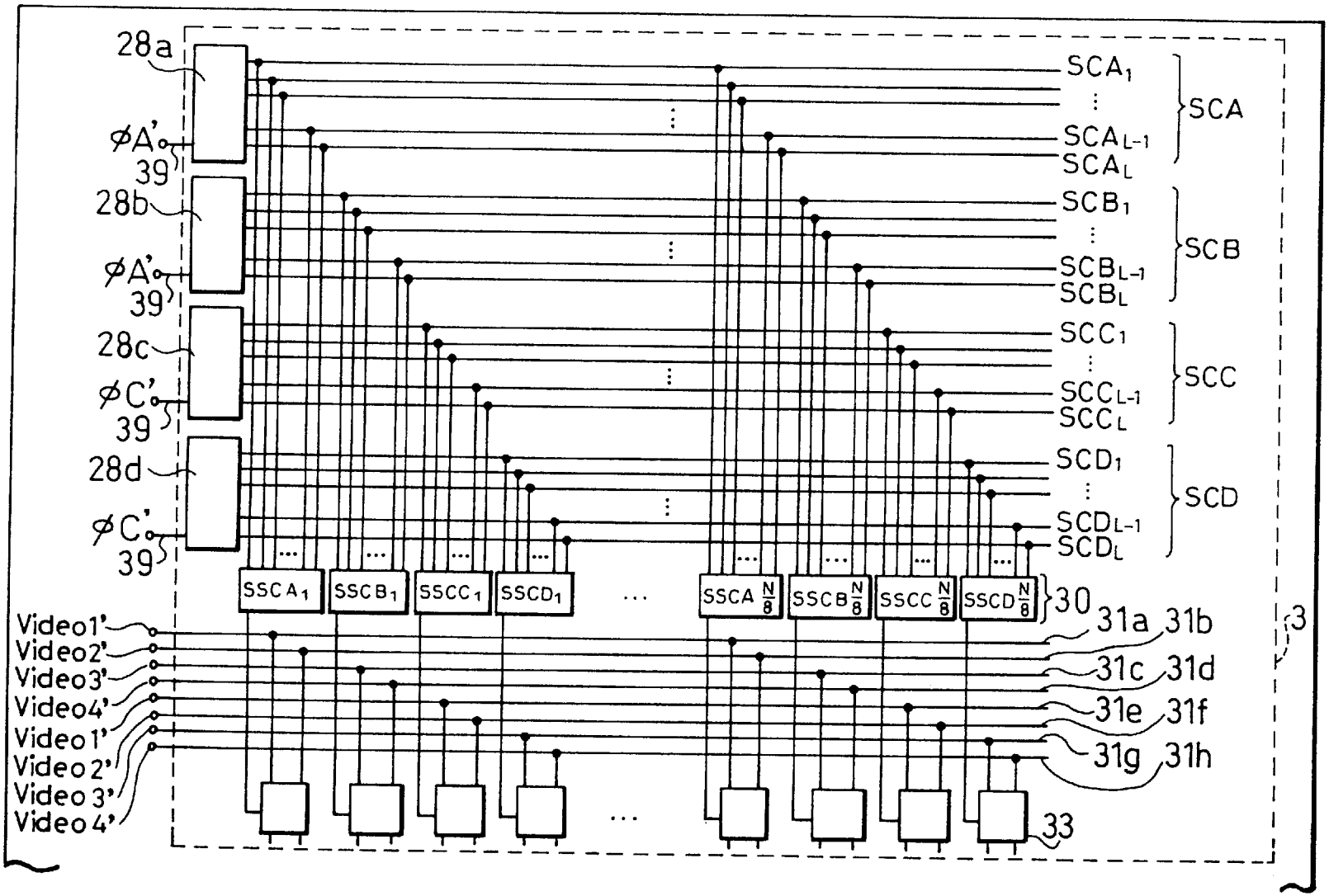
FIG. 15 is an explanatory drawing that shows signal inputs to a source driver in the case when four systems of video signals are inputted to eight video signal lines in the active-matrix-type liquid crystal display of FIG. 12.

2) Next, referring to FIG. 15, the following description will discuss the other driving operation in which an original video signal Video' having a scanning frequency of half the scanning frequency as originally designed is displayed.

In this case, the original video signal Video' is divided into four video signals Video 1' through Video 4' by the video-signal forming circuit in accordance with the scanning frequency. In addition, as illustrated in FIG. 15, eight video signal lines 31*a* through 31*h* are grouped so as to form four groups, that is, video signal lines 31*a* and 31*e*, video signal lines 31*b* and 31*f*, video signal lines 31*c* and 31*g* as well as video signal lines 31*d* and 31*h*, each group consisting of two lines. Then, the same video signal is inputted to the video signal lines that belong to the same group of the video signal lines. In other words, Video 1' is inputted to video signal lines 31*a* and 31*e*, Video 2' is inputted to video signal lines 31*b* and 31*f*, Video 3' is inputted to video signal lines 31*c* and 31*g*, and Video 4' is inputted to video signal lines 31*d* and 31*h*.

Figure 16:
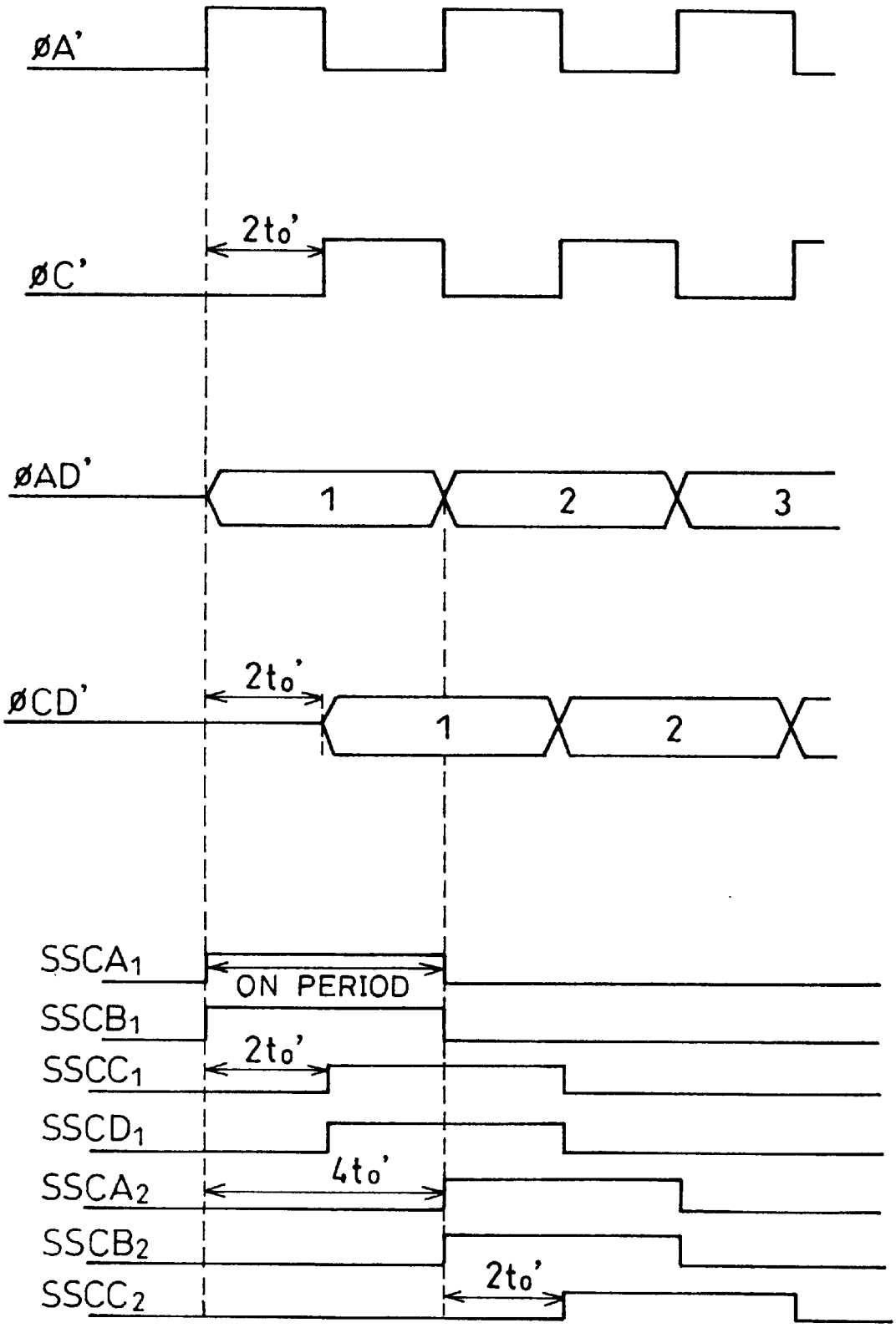
FIG. 16 is a timing chart of the source driver in the case when the four systems of video signals are inputted and driven in the active-matrix-type liquid crystal display of FIG. 12.

Then, the same shift clock signal ϕA' is inputted to selection-signal generating circuit 28*a* and selection-signal generating circuit 28*b*, and shift clock signal ϕC', whose phase is different from that of shift clock signal ϕA' by $2t_0'$, is inputted to selection-signal generating circuit 28*c* and selection-signal generating circuit 28*d* (see FIG. 16). Here, $t_0'$ is the sampling period of the original video signal Video' (the value obtained by dividing the effective horizontal scanning period by the number of the effective source bus lines). Further, shift clock signals ϕA' and ϕC' have the same phase and period as the aforementioned shift clock signals ϕA and ϕC with only different periods (see FIG. 14).

Based upon such clock signals ϕA' and ϕC', in the selecting circuit 30, SSCA system (decoder circuits $SSCA_1$ through $SSC_{N/8}$) and SSCB system (decoder circuits $SSCB_1$ through $SSCB_{N/8}$) are simultaneously turned on, and SSCC system (decoder circuits $SSCC_1$ through $SSCC_{N/8}$ and SSCD system (decoder circuits $SSCD_1$ through $SSCD_{N/8}$) are simultaneously turned on. Thus, the group consisting of SSCA system and SSCB system and the group consisting of SSCC system and SSCD system successively output ON waveforms having their phase mutually shifted by $2t_0'$ to the sample circuits 33 (see FIG. 16).

Figure 17:
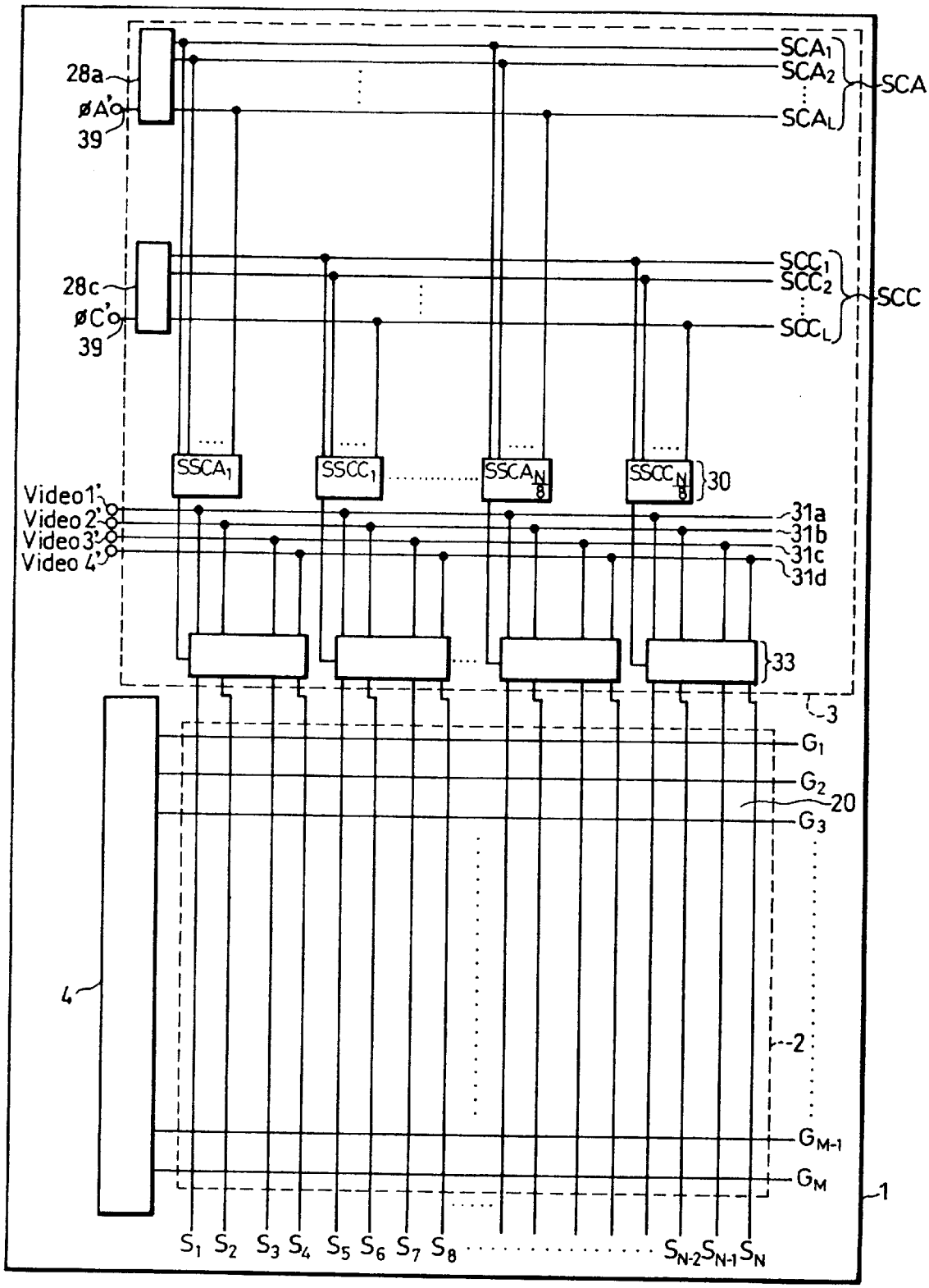
FIG. 17 is a circuit diagram of a pseudo active-matrix-type liquid crystal display to which the active-matrix-type liquid crystal display of FIG. 12 becomes equivalent by the respective signal inputs to the source driver shown in FIG. 15.
Figure 18:
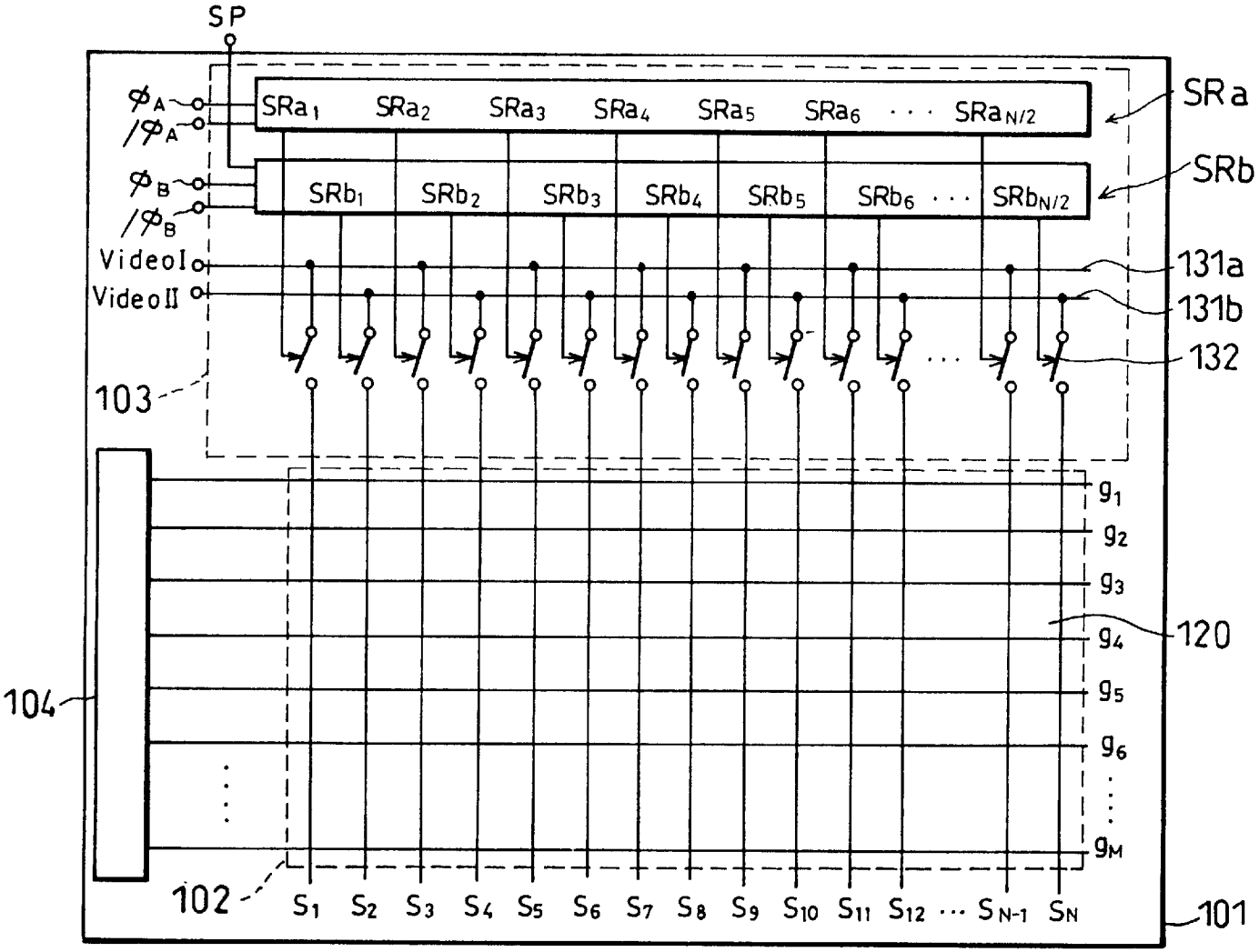
FIG. 18 is a circuit diagram of a conventional active-matrix-type liquid crystal display.
Figure 19:
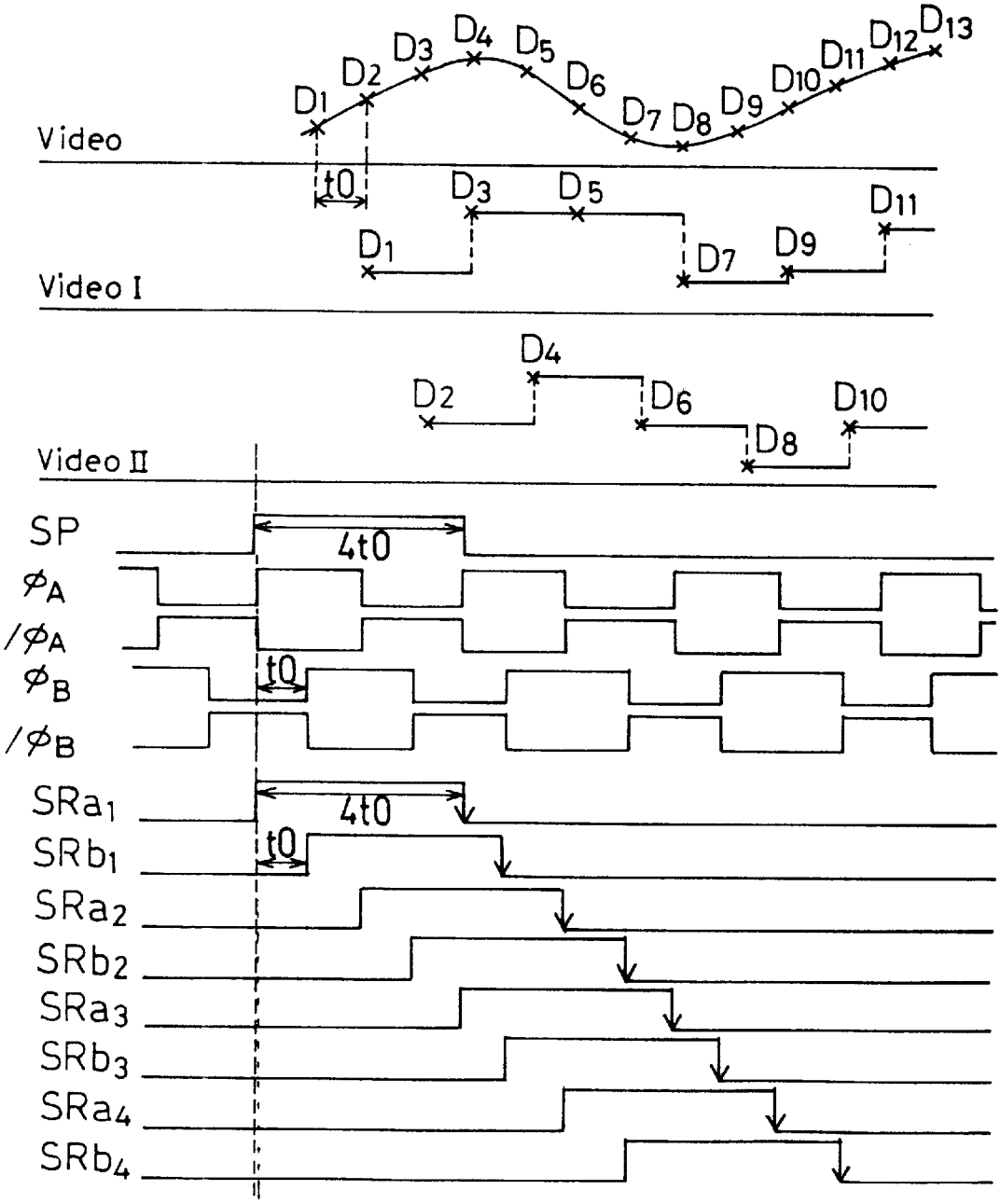
FIG. 19 is a timing chart of signals that are inputted to a source driver so as to drive the active-matrix-type liquid crystal display of FIG. 18.
Figure 20:
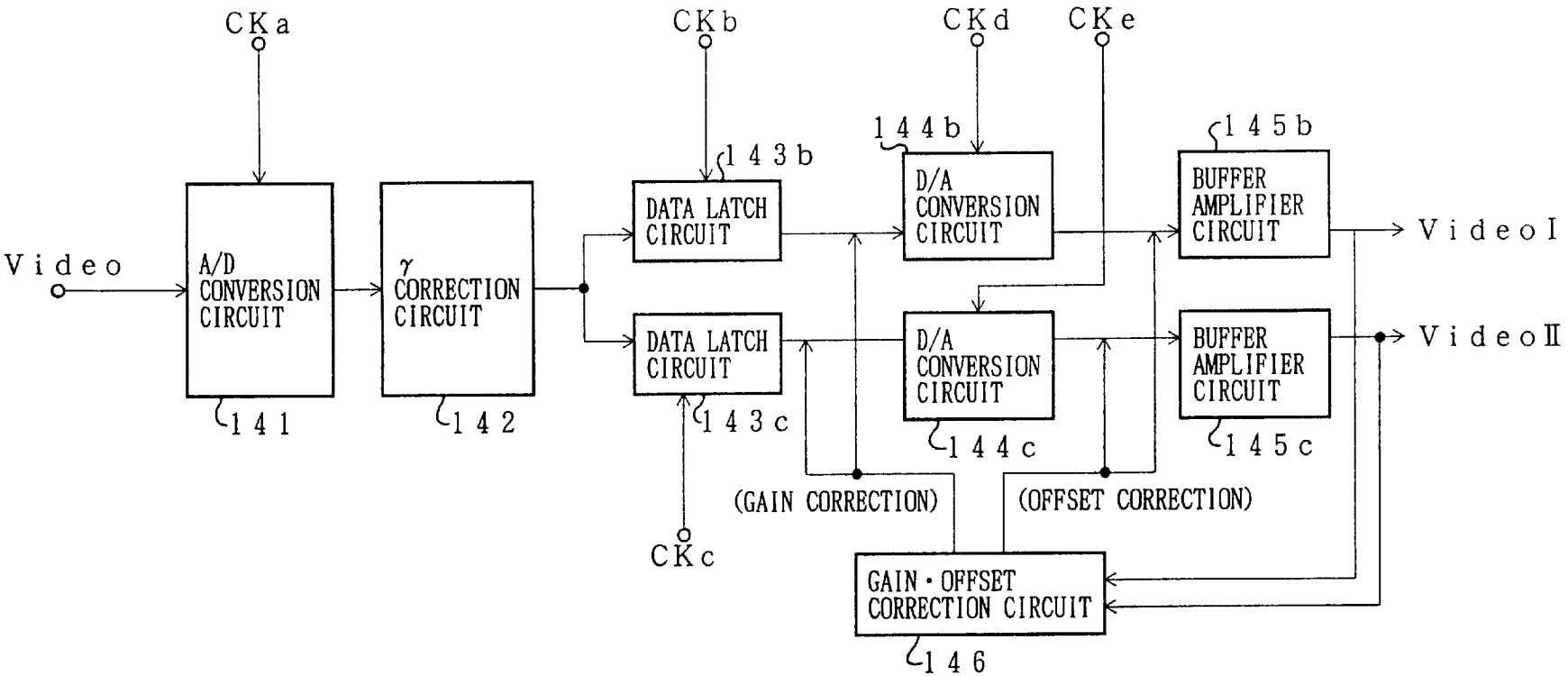
FIG. 20 is a block diagram of a video-signal forming circuit for forming two systems of video signals by dividing an original video signal into two.
Figure 21:
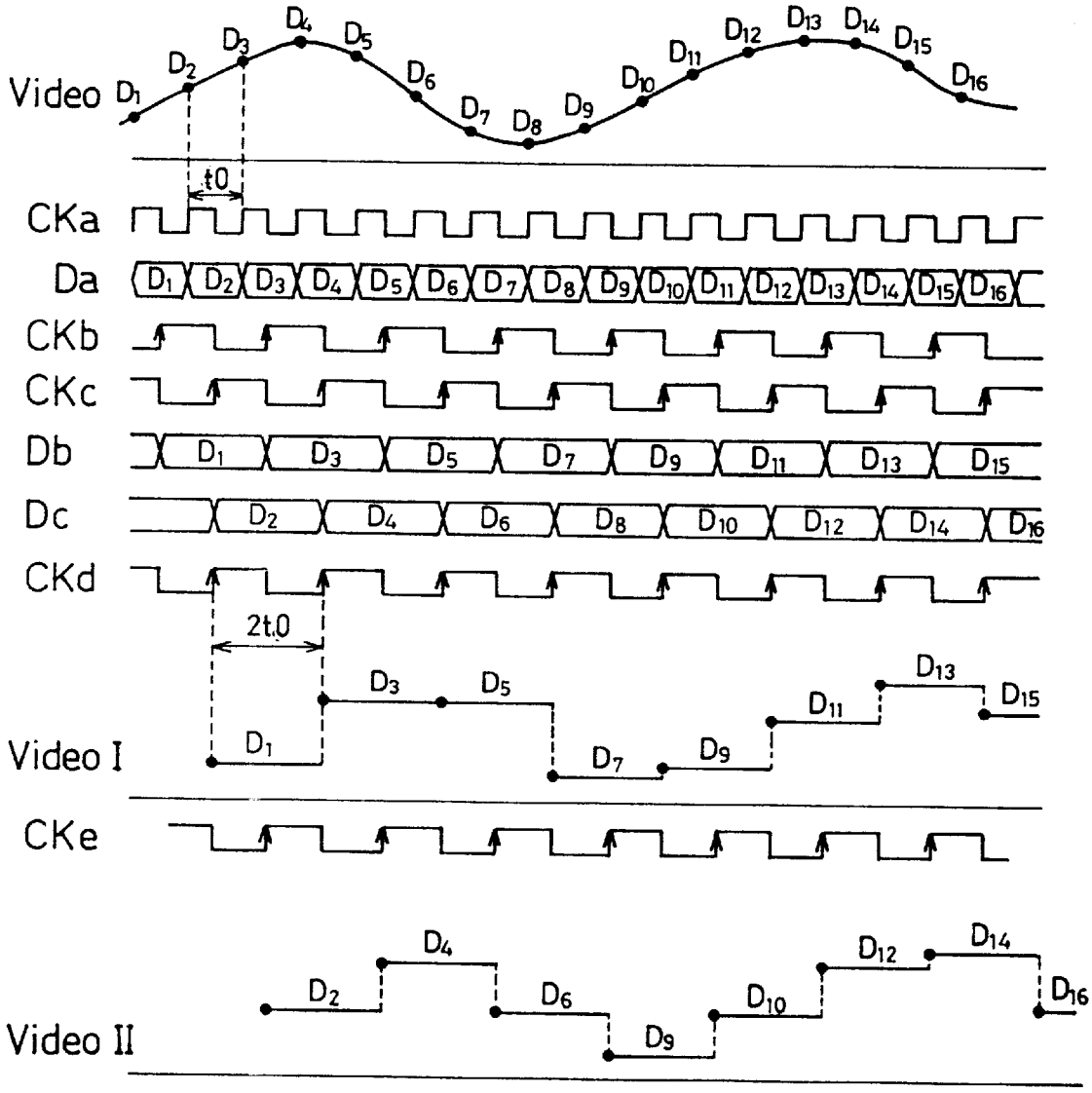
FIG. 21 is a timing chart of the circuit shown in FIG. 20 upon operation.

With this arrangement, since the adjacent two sampling circuits 33 are driven in the same manner, it is possible to provide the same driving operation as that of the active-matrix-type liquid crystal display shown in FIG. 17. In the active-matrix-type liquid crystal display as shown in FIG. 17, four video signal lines 31*a* through 31*d* are provided, four video signals Video 1' through Video 4' are received from four video signal lines 31*a* through 31*d*, and a driving operation is carried out so that the video signals are simultaneously sampled four by four by the sampling circuit 37 consisting of four adjacent analog switches 32 (see FIG. 9(*b*)).

In this case also, in the same manner as Embodiment *1*, the number of respective data latch circuits, D/A conversion circuits and buffer amplifier circuits, which are required for the video-signal forming circuit for forming 4-division video signals Video 1' through Video 4' from the original video signal Video', is only four; therefore, it is possible to reduce the cost by simplifying the external circuit construction such as the video-signal forming circuit, and also to prevent degradation in the display quality resulting from stripes that appear due to offset irregularities caused by an increase in the number of the buffer amplifier circuits. As a result, the same effects as obtained by Embodiment 1 can be obtained.

In this case also, upon designing the substrate, supposing that the total number of the video signal lines is F (8 in the above-mentioned case), the number of video signal lines to be simultaneously sampled is P (2 in the above-mentioned case) and the number of divisions of a shift clock signal to be inputted to the shift register section is X (4 in the above-mentioned case), such a driving method can be achieved if $F>P\geqq 1$ and $F\geqq X>1$ are satisfied under the condition that F, P and X are integral numbers. In order to construct desirable external circuits such as the video-signal forming circuit, it is preferable to set F, P and X as values obtained by raising 2 to the j-th power ($j\geqq 2$) or multiplying 2 to the h-th power ($h\geqq 3$) by 3, in which $X=F/P$ is satisfied.

The present embodiment was discussed by exemplifying an active-matrix-type liquid crystal display of a driving-circuit built-in type in which the source driver 3 and the gate driver 4 are monolithically formed on the substrate 1; however, the present invention is not intended to be limited by such a driving-circuit built-in type.

Additionally, at the input sides of eight video signal lines 31*a* through 31*h* and four clock signal lines 39 for inputting clock signals to selection-signal generating circuits 28*a* through 28*d*, the same switching means (a fourth switching means) as those of the video-signal selection circuit 40 described in Embodiment 2 may be installed so as to reduce the number of signal inputs to the source driver 3; thus, it becomes possible to improve the reliability of the active-matrix-type liquid crystal display, in the same manner as described before.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A driving method for an active-matrix-type image display that is provided with a plurality of gate bus lines and a plurality of source bus lines, which are mutually orthogonalized on a substrate, and a source driving circuit for driving the source bus lines, the source driving circuit being provided with switching means formed in the respective source bus lines and opening and closing control sections for controlling the opening and closing of the respective switching means, with the respective switching means being connected to a plurality of video signal lines one by one in succession, comprising the steps of:

dividing an original video signal into divided video signals in a number proportional to a scanning frequency of the original video signal;

when the scanning frequency of the original video signal is a scanning frequency initially set at a predetermined number, inputting different divided video signals to all the video signal lines;

when the number of the divided video signals is reduced in response to a reduction in the scanning frequency of the original video signal from the scanning frequency initially set at said predetermined number, dividing the plural video signal lines into groups the number of which corresponds to the reduced number of the divided video signals so that the same divided video signal is inputted to the video signal lines that belong to the same group.

2. The driving method for an active-matrix-type image display as defined in claim 1, wherein if the opening and closing control sections in the source driving circuit are constituted by shift registers forming a plurality of systems, the number of divisions of shift clock signals corresponding to the number of the systems of the shift registers is reduced in accordance with the number of divisions of the video signal lines so that the same driving operation can be carried out by inputting the same shift clock signal to different shift registers.

3. The driving method for an active-matrix-type image display as defined in claim 2, wherein the number of divisions of shift start signals corresponding to the number of the systems of the shift registers is reduced in accordance with the number of divisions of the video signal lines so that the same shift clock signal is inputted to different shift registers.

4. The driving method for an active-matrix-type image display as defined in claim 1, wherein, if the opening and closing control sections in the source driving circuit are constituted by decoder circuits forming a plurality of systems, the number of divisions of signals to be supplied to the respective decoder circuits is reduced in accordance with the number of divisions of the video signal lines so that the same driving operation can be carried out by inputting the same signal to different decoder circuits.

5. An active-matrix-type image display comprising:

a plurality of gate bus lines and a plurality of source bus lines, which are mutually orthogonalized on a substrate;

a source driving circuit for driving the source bus lines, the source driving circuit being provided with switching means formed in the respective source bus lines and opening and closing control sections for controlling the opening and closing of the respective switching means, with the respective switching means being connected to the plural video signal lines one by one in succession; and a first switching means for making switchovers between a state in which the plural video signal lines are disconnected from each other so that discrete video signals are transmitted and a state in which predetermined video signal lines, selected among the plural video signal lines, are connected to each other so that the same video signal is transmitted in the predetermined video signal lines.

6. The active-matrix-type image display as defined in claim 5, wherein the opening and closing control section of the source driving circuit is constituted by shift registers forming a plurality of systems, and a second switching means, which makes switchovers between a state in which a plurality of shift clock signal lines, which supply shift clock signals to the shift registers, are mutually disconnected so as to transmit discrete shift clock signals and a state in which predetermined shift clock signal lines, selected among the plural shift clock signal lines, are connected so as to transmit the same shift clock signal in the predetermined shift clock signal lines, is installed.

7. The active-matrix-type image display as defined in claim 6, further comprising:

third switching means for making switchovers between a state in which a plurality of shift start signal lines, which supply shift start signals to the shift registers, are mutually disconnected so as to transmit discrete shift start signals and a state in which predetermined shift start signal lines, selected among the plural shift start signal lines, are connected so as to transmit the same shift start signal in the predetermined shift start signal lines.

8. The active-matrix-type image display as defined in claim 5, wherein: the opening and closing control section of the source driving circuit is constituted by decoder circuits forming a plurality of systems, and a fourth switching means, which makes switchovers between a state in which a plurality of signal lines, which supply signals to the decoder circuits, are mutually disconnected so as to transmit discrete signals and a state in which predetermined signal lines, selected among the plural signal lines, are connected so as to transmit the same signal in the predetermined signal lines, is installed.

9. The active-matrix-type image display as defined in claim 5, wherein: the circuit constituting the switching means, the source driving circuit and a gate driving circuit for driving the gate bus lines are formed on the same substrate that is provided with the source bus lines and gate bus lines.

10. A driving method for an active-matrix-type image display that is provided with a plurality of gate bus lines and a plurality of source bus lines, which are mutually orthogonalized on a substrate, and a source driving circuit for driving the source bus lines, the source driving circuit being provided with a switching circuit connected to a plurality of video signal lines for transmitting a video signal, comprising the steps of:

dividing an original video signal into divided video signals in a number proportional to a scanning frequency of the original video signal;

when the number of the divided video signals is equal to a number of the video signal lines, inputting different divided video signals to all the video signal lines;

when the number of the divided video signals is fewer than the number of the video signal lines, dividing the plural video signal lines into groups the number of which is equal to the number of the divided video signals so that the same divided video signal is inputted to the video signal lines that belong to the same group.

11. An active-matrix-type image display comprising:

a plurality of gate bus lines and a plurality of source bus lines, which are mutually orthogonalized on a substrate;

a source driving circuit for driving the source bus lines, the source driving circuit being provided with a switching circuit connected to a plurality of video signal lines for transmitting a video signal; and a first switching means for making switchovers between a state in which the video signal lines are mutually disconnected so as to transmit discrete video signals in accordance with the scanning frequency of a video signal and a state in which predetermined video signal lines, selected among the plural video signal lines, are selectively connected so as to transmit the same video signal in the predetermined video signal lines.

* * * * *